US009558629B2

(12) United States Patent
Schaefer et al.

(10) Patent No.: US 9,558,629 B2
(45) Date of Patent: Jan. 31, 2017

(54) GAMING SYSTEM AND METHOD FOR PROVIDING A PLURALITY OF CHANCES OF WINNING A PROGRESSIVE AWARD

(71) Applicant: IGT, Las Vegas, NV (US)

(72) Inventors: Craig M. Schaefer, Las Vegas, NV (US); Christopher B. Drake, Reno, NV (US); Brian A. Johnson, Las Vegas, NV (US); Victoria A. Fuller, Los Angeles, CA (US); Cameron A. Filipour, Las Vegas, NV (US); William Jay Foster, Reno, NV (US); Dirk Geere, Henderson, NV (US); Misty Ann Johnson, Reno, NV (US); Joseph Louis Masinter, II, Las Vegas, NV (US); Vincent Paul Smith, Las Vegas, NV (US)

(73) Assignee: IGT, Las Vegas, NV (US)

( * ) Notice: Subject to any disclaimer, the term of this patent is extended or adjusted under 35 U.S.C. 154(b) by 446 days.

(21) Appl. No.: 14/031,558

(22) Filed: Sep. 19, 2013

(65) Prior Publication Data

US 2015/0080119 A1 Mar. 19, 2015

(51) Int. Cl.
*A63F 9/24* (2006.01)
*G07F 17/32* (2006.01)

(52) U.S. Cl.
CPC ..... *G07F 17/3258* (2013.01)

(58) Field of Classification Search
CPC ..... G07F 17/3258; G07F 17/3262
USPC ..... 463/30–33, 40–42, 25–27
See application file for complete search history.

(56) References Cited

U.S. PATENT DOCUMENTS

| | | | |
|---|---|---|---|
| 4,837,728 | A | 6/1989 | Barrie et al. |
| 4,861,041 | A | 8/1989 | Jones et al. |
| 5,116,055 | A | 5/1992 | Tracy |
| 5,249,800 | A | 10/1993 | Hilgendorf et al. |
| 5,280,909 | A | 1/1994 | Tracy |
| 5,344,144 | A | 9/1994 | Canon |
| 5,364,104 | A | 11/1994 | Jones et al. |
| 5,377,973 | A | 1/1995 | Jones et al. |
| 5,417,430 | A | 5/1995 | Breeding |
| 5,564,700 | A | 10/1996 | Celona |
| 5,580,309 | A | 12/1996 | Piechowiak et al. |
| 5,611,730 | A | 3/1997 | Weiss |
| 5,645,486 | A | 7/1997 | Nagao et al. |
| 5,647,592 | A | 7/1997 | Gerow |

(Continued)

FOREIGN PATENT DOCUMENTS

| | | |
|---|---|---|
| GB | 2313792 | 12/1997 |
| WO | WO/99/03078 | 1/1999 |

(Continued)

*Primary Examiner* — Omkar Deodhar
*Assistant Examiner* — Ross Williams
(74) *Attorney, Agent, or Firm* — Neal, Gerber & Eisenberg LLP

(57) ABSTRACT

The gaming system disclosed herein provides a player one or more chances or opportunities to win the same progressive award. In these embodiments, the gaming system provides the player one or more opportunities to win a progressive award in association with a first game sequence. If the player does not win the progressive award in association with the first game sequence, the gaming system determines whether to provide the player any additional chances or opportunities to win the same progressive award in a second game sequence.

16 Claims, 13 Drawing Sheets

(56) References Cited

U.S. PATENT DOCUMENTS 5,655,961 A 8/1997 Acres et al.
5,702,304 A 12/1997 Acres et al.
5,741,183 A 4/1998 Acres et al.
5,766,076 A 6/1998 Pease et al.
5,820,459 A 10/1998 Acres et al.
5,851,147 A 12/1998 Stupak et al.
5,876,284 A 3/1999 Acres et al.
5,885,158 A 3/1999 Torango et al.
5,911,626 A 6/1999 McCrea, Jr.
5,941,773 A 8/1999 Harlick
5,944,606 A 8/1999 Gerow
5,951,011 A 9/1999 Potter et al.
6,012,982 A 1/2000 Piechowiak et al.
6,032,955 A 3/2000 Luciano et al.
6,089,980 A 7/2000 Gauselmann
6,102,799 A 8/2000 Stupak
6,110,043 A 8/2000 Olsen
6,146,273 A 11/2000 Olsen
6,162,122 A 12/2000 Acres et al.
6,203,010 B1 3/2001 Jorasch et al.
6,210,275 B1 4/2001 Olsen
6,217,448 B1 4/2001 Olsen
6,224,482 B1 5/2001 Bennett
6,224,484 B1 5/2001 Okuda et al.
6,231,445 B1 5/2001 Acres
6,241,608 B1 6/2001 Torango
6,254,483 B1 7/2001 Acres
6,257,981 B1 7/2001 Acres et al.
6,266,103 B1 7/2001 Barton et al.
6,312,333 B1 11/2001 Acres
6,336,862 B1 1/2002 Byrne
6,358,149 B1 3/2002 Schneider et al.
6,364,314 B1 4/2002 Canterbury
6,364,768 B1 4/2002 Acres et al.
6,371,852 B1 4/2002 Acres
6,375,567 B1 4/2002 Acres
6,375,569 B1 4/2002 Acres
6,394,902 B1 * 5/2002 Glavich ..... G07F 17/3244 273/143 R
6,416,409 B1 7/2002 Jordan
6,431,983 B2 8/2002 Acres
6,435,511 B1 8/2002 Vancura et al.
6,435,968 B1 8/2002 Torango
RE37,885 E 10/2002 Acres et al.
6,565,434 B1 5/2003 Acres
6,575,832 B1 6/2003 Manfredi et al.
6,589,115 B2 7/2003 Walker et al.
6,592,458 B1 7/2003 Ho
6,599,188 B2 7/2003 Hirsch et al.
6,599,193 B2 7/2003 Baerlocher et al.
6,604,997 B2 8/2003 Saidakovsky et al.
6,607,441 B1 8/2003 Acres
6,629,177 B1 9/2003 Chong
6,656,052 B2 12/2003 Abramopoulos et al.
6,676,513 B2 1/2004 Gauselmann
6,712,695 B2 3/2004 Mothwurf et al.
6,712,697 B2 3/2004 Acres
6,776,715 B2 8/2004 Price
6,800,030 B2 10/2004 Acres
6,832,958 B2 12/2004 Acres et al.
6,835,134 B2 12/2004 Poole et al.
6,878,063 B2 4/2005 Manfredi et al.
6,887,154 B1 5/2005 Luciano, Jr. et al.
6,910,964 B2 6/2005 Acres
RE38,812 E 10/2005 Acres et al.
7,004,466 B2 2/2006 Gauselmann
7,037,195 B2 5/2006 Schneider et al.
7,048,628 B2 5/2006 Schneider
7,056,215 B1 6/2006 Olive
7,070,505 B2 7/2006 Vancura et al.
7,297,059 B2 11/2007 Vancura et al.
7,357,716 B2 4/2008 Marks et al.
7,384,337 B2 * 6/2008 Thomas ..... G07F 17/32 463/27
7,470,184 B2 12/2008 Baerlocher et al.
7,651,392 B2 1/2010 Pennington et al.
7,662,040 B2 2/2010 Englman et al.
7,666,093 B2 2/2010 Lafky et al.
7,713,120 B2 5/2010 Cannon
7,753,784 B2 7/2010 Baerlocher
7,780,531 B2 8/2010 Englman et al.
7,874,915 B2 1/2011 Caspers et al.
7,914,377 B2 3/2011 Benbrahim
7,931,530 B2 4/2011 Anderson et al.
7,942,737 B2 5/2011 Cregan et al.
8,033,903 B2 10/2011 Cregan
8,070,597 B2 12/2011 Cuddy
8,092,302 B2 1/2012 Cuddy et al.
8,096,874 B2 1/2012 Nicely et al.
8,113,939 B2 2/2012 Cannon
8,128,491 B2 3/2012 Vasquez et al.
8,157,646 B2 4/2012 Pawloski et al.
8,197,337 B2 6/2012 DeWaal et al.
8,210,937 B2 7/2012 Cregan et al.
8,231,453 B2 7/2012 Wolf et al.
8,251,805 B2 8/2012 Englman et al.
8,328,631 B2 12/2012 Baerlocher
8,337,298 B2 12/2012 Baerlocher
8,353,761 B2 1/2013 Kelly et al.
8,408,994 B2 4/2013 Baerlocher et al.
8,435,111 B2 5/2013 Filipour et al.
8,449,387 B2 5/2013 Englman et al.
8,454,434 B1 6/2013 Schaefer
8,480,485 B2 7/2013 Englman et al.
8,500,548 B2 8/2013 Baerlocher et al.
2001/0036857 A1 11/2001 Mothwurf et al.
2002/0042299 A1 4/2002 Soltys et al.
2002/0160825 A1 10/2002 Nicastro et al.
2003/0027625 A1 2/2003 Rowe
2003/0036425 A1 2/2003 Kaminkow et al.
2003/0054877 A1 3/2003 Baerlocher
2003/0119586 A1 6/2003 Crumby
2003/0181231 A1 9/2003 Vancura et al.
2003/0209853 A1 11/2003 Harris
2003/0211884 A1 11/2003 Gauselmann
2003/0222402 A1 12/2003 Olive
2003/0228899 A1 12/2003 Evans
2003/0236116 A1 12/2003 Marks et al.
2004/0009808 A1 1/2004 Gauselmann
2004/0023716 A1 2/2004 Gauselmann
2004/0038741 A1 2/2004 Gauselmann
2004/0048644 A1 3/2004 Gerrard et al.
2004/0092304 A1 5/2004 George et al.
2004/0102238 A1 5/2004 Taylor
2004/0166918 A1 8/2004 Walker et al.
2004/0242320 A1 12/2004 Jackson
2005/0003880 A1 1/2005 Englman et al.
2005/0003886 A1 1/2005 Englman et al.
2005/0037837 A1 2/2005 Rowe
2005/0054429 A1 3/2005 Baerlocher et al.
2005/0054434 A1 3/2005 Baerlocher et al.
2005/0055113 A1 3/2005 Gauselmann
2005/0059467 A1 3/2005 Saffari et al.
2005/0059472 A1 3/2005 Joshi et al.
2005/0059481 A1 3/2005 Joshi et al.
2005/0064930 A1 3/2005 Jubinville et al.
2005/0096130 A1 5/2005 Mullins
2005/0137010 A1 6/2005 Enzminger et al.
2005/0176494 A1 8/2005 Thomas
2005/0192088 A1 9/2005 Hartman et al.
2005/0215313 A1 9/2005 O'Halloran
2005/0215314 A1 9/2005 Schneider et al.
2005/0288081 A1 12/2005 Amaitis et al.
2006/0003829 A1 1/2006 Thomas
2006/0009283 A1 1/2006 Englman et al.
2006/0019737 A1 1/2006 Yang
2006/0025195 A1 2/2006 Pennington et al.
2006/0025210 A1 2/2006 Johnson
2006/0030399 A1 2/2006 Baerlocher
2006/0030403 A1 2/2006 Lafky et al.
2006/0052159 A1 3/2006 Cahill et al.
2006/0073887 A1 4/2006 Nguyen et al.
2006/0073889 A1 4/2006 Edidin et al.
2006/0073897 A1 4/2006 Englman et al.

(56) References Cited

U.S. PATENT DOCUMENTS

| | | | |
|---|---|---|---|
| 2006/0100019 | A1 | 5/2006 | Hornik et al. |
| 2006/0116201 | A1 | 6/2006 | Gauselmann |
| 2006/0135243 | A1 | 6/2006 | Englman et al. |
| 2006/0142079 | A1 | 6/2006 | Ikehara et al. |
| 2006/0142086 | A1 | 6/2006 | Blackburn et al. |
| 2006/0154718 | A1 | 7/2006 | Willyard et al. |
| 2006/0178203 | A1 | 8/2006 | Hughes et al. |
| 2006/0183535 | A1 | 8/2006 | Marks et al. |
| 2006/0183537 | A1 | 8/2006 | Dickerson |
| 2006/0183538 | A1 | 8/2006 | Michaelson et al. |
| 2006/0281527 | A1 | 12/2006 | Dunaevsky et al. |
| 2006/0287043 | A1 | 12/2006 | Englman et al. |
| 2006/0287077 | A1 | 12/2006 | Grav et al. |
| 2007/0026941 | A1 | 2/2007 | Block et al. |
| 2007/0054733 | A1 | 3/2007 | Baerlocher |
| 2007/0060244 | A1 | 3/2007 | Yaldoo et al. |
| 2007/0060271 | A1 | 3/2007 | Cregan et al. |
| 2007/0060314 | A1 | 3/2007 | Baerlocher et al. |
| 2007/0060319 | A1 | 3/2007 | Block et al. |
| 2007/0060320 | A1 | 3/2007 | Kelly et al. |
| 2007/0060365 | A1 | 3/2007 | Tien et al. |
| 2007/0167210 | A1 | 7/2007 | Kelly et al. |
| 2007/0167226 | A1 | 7/2007 | Kelly et al. |
| 2007/0259709 | A1 | 11/2007 | Kelly et al. |
| 2007/0259711 | A1 | 11/2007 | Thomas |
| 2007/0265065 | A1* | 11/2007 | Seelig ..... G07F 17/32 463/25 |
| 2008/0015005 | A1 | 1/2008 | Yaldoo et al. |
| 2008/0015012 | A1 | 1/2008 | Englman et al. |
| 2008/0045341 | A1 | 2/2008 | Englman |
| 2008/0070679 | A1 | 3/2008 | Seelig et al. |
| 2008/0076503 | A1 | 3/2008 | Mattice et al. |
| 2008/0090651 | A1 | 4/2008 | Baerlocher |
| 2008/0108410 | A1 | 5/2008 | Baerlocher |
| 2008/0108425 | A1 | 5/2008 | Oberberger |
| 2008/0108430 | A1 | 5/2008 | Evans |
| 2008/0108431 | A1 | 5/2008 | Cuddy et al. |
| 2008/0113770 | A1 | 5/2008 | Gelber et al. |
| 2008/0254883 | A1 | 10/2008 | Patel et al. |
| 2008/0254893 | A1 | 10/2008 | Patel et al. |
| 2008/0261683 | A1 | 10/2008 | Russell et al. |
| 2008/0305864 | A1 | 12/2008 | Kelly et al. |
| 2008/0305865 | A1 | 12/2008 | Kelly et al. |
| 2008/0305866 | A1 | 12/2008 | Kelly et al. |
| 2009/0042638 | A1 | 2/2009 | Thomas |
| 2009/0042645 | A1 | 2/2009 | Graham et al. |
| 2009/0088244 | A1 | 4/2009 | Nicely et al. |
| 2009/0124362 | A1 | 5/2009 | Cuddy et al. |
| 2009/0124364 | A1 | 5/2009 | Cuddy et al. |
| 2009/0247277 | A1 | 10/2009 | Caspers et al. |
| 2009/0247292 | A1 | 10/2009 | Caspers et al. |
| 2010/0016060 | A1 | 1/2010 | Jaffe |
| 2010/0124973 | A1 | 5/2010 | DeWaal et al. |
| 2010/0267442 | A1 | 10/2010 | Englman et al. |
| 2010/0304830 | A1 | 12/2010 | Englman et al. |
| 2011/0003636 | A1 | 1/2011 | Thomas et al. |
| 2011/0003637 | A1 | 1/2011 | LeFever |
| 2011/0111843 | A1 | 5/2011 | Nicely et al. |
| 2011/0124402 | A1 | 5/2011 | De Waal et al. |
| 2011/0165938 | A1 | 7/2011 | Anderson et al. |
| 2011/0201410 | A1 | 8/2011 | Englman et al. |
| 2011/0269537 | A1 | 11/2011 | Mattice et al. |
| 2012/0021816 | A1 | 1/2012 | Aoki |
| 2012/0046098 | A1 | 2/2012 | Cuddy |
| 2013/0225277 | A1 | 8/2013 | Hughes |
| 2013/0231170 | A1 | 9/2013 | Macaulay |

FOREIGN PATENT DOCUMENTS

| | | |
|---|---|---|
| WO | WO/01/33478 | 5/2001 |
| WO | WO/2005/032675 | 4/2005 |
| WO | WO/2005/099425 | 10/2005 |
| WO | WO/2005/099845 | 10/2005 |
| WO | WO/2005/110563 | 11/2005 |
| WO | WO/2005/113093 | 12/2005 |
| WO | WO/2006/014770 | 2/2006 |
| WO | WO/2006/014990 | 2/2006 |
| WO | WO/2006/039349 | 4/2006 |
| WO | WO/2006/044252 | 4/2006 |
| WO | WO/2006/130597 | 12/2006 |
| WO | WO/2006/130611 | 12/2006 |
| WO | WO/2007/028108 | 3/2007 |
| WO | WO/2007/030552 | 3/2007 |
| WO | WO/2007/030632 | 3/2007 |
| WO | WO/2007/030733 | 3/2007 |
| WO | WO/2007/032945 | 3/2007 |
| WO | WO/2007/117502 | 10/2007 |
| WO | WO/2007/123858 | 11/2007 |
| WO | WO/2007/130464 | 11/2007 |
| WO | WO/2008/005366 | 1/2008 |
| WO | WO/2008/021449 | 2/2008 |
| WO | WO/2008/039403 | 4/2008 |
| WO | WO/2008/057356 | 5/2008 |
| WO | WO/2008/060978 | 5/2008 |
| WO | WO/2008/063297 | 5/2008 |
| WO | WO/2008/063394 | 5/2008 |

* cited by examiner

YOU ACCUMULATED TWO PROGRESSIVE AWARD SYMBOLS. YOU WIN AN AWARD OF 75 FOR YOUR SELECTIONS. BUT WAIT, YOUR TWO ACCUMULATED PROGRESSIVE AWARD SYMBOLS BUYS YOU ANOTHER CHANCE TO WIN THE MAJOR PROGRESSIVE AWARD. GOOD LUCK.

GAMING SYSTEM AND METHOD FOR PROVIDING A PLURALITY OF CHANCES OF WINNING A PROGRESSIVE AWARD

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award).

Gaming machines which provide secondary or bonus games are also known. The secondary or bonus games usually provide an additional award, such as a bonus award, to the player. Secondary or bonus games usually do not require an additional wager by the player to be activated. Instead, secondary or bonus games are generally activated or triggered upon an occurrence of a designated triggering symbol or triggering symbol combination in the primary or base game. When a secondary or bonus game is triggered, the gaming machine generally indicates this triggering to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Progressive awards associated with gaming machines are also known. In one form, a progressive award is an award amount which includes an initial amount funded by a casino and an additional amount funded through a portion of each wager made on the progressive gaming machines. Typically, the progressive award grows in value as players play the gaming machines and more portions of these players' wagers are allocated to the progressive award. When a player obtains a winning symbol or winning symbol combination associated with the progressive award, the accumulated progressive award is provided to the player. After the progressive award is provided to the player, the amount of the next progressive award is reset to the initial value and a portion of each subsequent wager on a gaming machine associated with a progressive award is allocated to the next progressive award.

A progressive award may be associated with or otherwise dedicated to a single or stand-alone gaming machine. Alternatively, a progressive award may be associated with or otherwise dedicated to multiple gaming machines which each contribute a portion of wagers placed at such gaming machine(s) to the progressive award. The multiple gaming machines may be in the same bank of gaming machines, in the same casino or gaming establishment (usually through a local area network ("LAN")) or in two or more different casinos or gaming establishments (usually through a wide area network ("WAN")). Such progressive awards are played for by one or more gaming machines in the same gaming establishment are sometimes called local area progressives ("LAP") and such progressive awards played for by a plurality of gaming machines at a plurality of different gaming establishments are sometimes called wide area progressives ("WAP"). Moreover, a gaming machine or bank of gaming machines may be simultaneously associated with a plurality of progressive awards. In these multi-level progressive award ("MLP") configurations, a plurality of progressive awards start at different progressive award or value levels, such as $10, $100, $1000 and $10,000 and each individually increment or increase until provided to a player. Upon a suitable triggering event at one of more of the gaming machines associated with the MLP, one or more of the progressive awards which form the MLP are provided to one or more of the players at such gaming machines. Similar to gaming machines which employ secondary games, gaming machines which employ progressive awards provide excitement and enjoyment for players.

A continuing need exists to provide progressive awards to players.

SUMMARY

The present disclosure relates generally to gaming systems and methods for providing a plurality of chances to win a progressive award.

In various embodiments, the gaming system disclosed herein provides the player a first quantity of one or more opportunities to win a progressive award in association with a first game sequence. If the player does not win the progressive award in association with the first game sequence, the gaming system determines whether to provide the player any additional chances or opportunities to win the same progressive award in a second game sequence. In these embodiments, this determination of whether to avail the player to one or more additional opportunities to win the same progressive award is based, at least in part, on one or more events and/or determinations, associated with the first game sequence. That is, the gaming system determines, at least partially based on one or more events of a first game sequence: (i) whether to provide a progressive award to a player, and (ii) whether to provide the player zero, one or more additional chances to win the same progressive award in association with a second game sequence. Put differently, in response to one occurrence of a triggering event, the gaming system employs a first game phase including one or more chances to win a progressive award and further employs a second game phase including zero, one or more chances to win the same progressive award, wherein the results of the first game phase at least partially determine the player's probability of winning the progressive award in the second game phase (i.e., the results of the first game phase at least partially determine the quantity of progressive award chances of the second game phase). The gaming system disclosed herein is thus configured to provide a player one or more separate, independent and different chances to obtain the same progressive award in distinct related game sequences, wherein the quantity of chances provided is based on one or more aspects of the player's gaming experience in at least one of the game sequences. Such a configuration provides an increased level of excitement and enjoyment for certain players because these players enjoy such additional chances to win a progressive award.

More specifically, in various embodiments, the gaming system maintains one or more progressive awards. In these embodiments, upon a progressive award opportunity triggering event associated with one of the progressive awards, the gaming system triggers a progressive award opportunity sequence. In certain embodiments, a progressive award opportunity triggering event occurs independent of any displayed event associated with any plays of any of primary games and/or any plays of any secondary games. In certain other embodiments, a progressive award opportunity triggering event occurs in association with a displayed event of a play of a primary game and/or a play of a secondary game.

For the triggered progressive award opportunity sequence, the gaming system determines and displays one or more progressive award opportunity sequence outcomes, such as one or more symbols or symbol combinations. In this embodiment, the determined and displayed progressive award opportunity sequence outcomes are selected from a plurality of different progressive award opportunity sequence outcomes, wherein at least one of the progressive award opportunity sequence outcomes is associated with the progressive award. In one such embodiment, the triggered progressive award opportunity sequence includes a plurality of outcome determinations wherein different outcome determinations are associated with different probabilities of determining and displaying a progressive award opportunity sequence outcome association with the progressive award. For example, the progressive award opportunity sequence includes a multi-round selection game wherein one or more of the selections of each round are associated with the progressive award and the gaming system determines, for each round, one or more progressive award opportunity sequence outcomes based on one or more picks of these selections.

Following the determination and display of one or more progressive award opportunity sequence outcomes of the triggered progressive award opportunity sequence, the gaming system determines whether to provide the progressive award to the player. In one embodiment, this determination is based on the quantity of determined and displayed progressive award opportunity sequence outcomes associated with the progressive award. In one such embodiment, this determination is based on if a quantity of determined and displayed progressive award opportunity sequence outcomes associated with the progressive award reach a winning progressive award outcome threshold. For example, if the gaming system determines and displays five progressive award opportunity sequence outcomes in five rounds of the triggered progressive award opportunity sequence and the winning progressive award outcome threshold is five progressive award opportunity sequence outcomes associated with the progressive award, the gaming system determines whether all five of these determined and displayed progressive award opportunity sequence outcomes were each associated with the progressive award. In this example, if all five of the determined and displayed progressive award opportunity sequence outcomes are each associated with the progressive award (i.e., the winning progressive award outcome threshold is reached), the gaming system provides the progressive award to the player. On the other hand, if less than five of the determined and displayed progressive award opportunity sequence outcomes are each associated with the progressive award (i.e., the winning progressive award outcome threshold is not reached), the gaming system does not provide the progressive award to the player.

Following any determination not to provide the progressive award to the player in association with the triggered progressive award opportunity sequence, the gaming system determines whether to proceed to a progressive award supplemental opportunity sequence to provide the player one or more additional chances to win the same progressive award. In one embodiment, this determination of whether to proceed to a progressive award supplemental opportunity sequence is based on one or more of the determined and displayed progressive award opportunity sequence outcomes of the triggered progressive award opportunity sequence. In these embodiments, based on the progressive award opportunity sequence outcomes of the triggered progressive award sequence, the gaming system first determines whether to provide a progressive award to a player and further determines (if the first determination is not to provide the progressive award) whether to provide any additional chances or opportunities to win the same progressive award. In one such embodiment, the determination of whether to proceed to a progressive award supplemental opportunity sequence is based on if a quantity of determined and displayed progressive award opportunity sequence outcomes associated with the progressive award reach an additional opportunity progressive award outcome threshold. Continuing with the above example, if the additional opportunity progressive award outcome threshold is four progressive award opportunity sequence outcomes associated with the progressive award, the gaming system determines whether four of the determined and displayed progressive award opportunity sequence outcomes of the triggered progressive award opportunity sequence were each associated with the progressive award. In this example, if four of the determined and displayed progressive award opportunity sequence outcomes were each associated with the progressive award (i.e., the additional opportunity progressive award outcome threshold is reached), the gaming system proceeds to the progressive award supplemental opportunity sequence. On the other hand, if zero to three of the determined and displayed progressive award opportunity sequence outcomes were each associated with the progressive award (i.e., the additional opportunity progressive award outcome threshold is not reached), the gaming system does not proceed to the progressive award supplemental opportunity sequence. Accordingly, as seen in this example, even if the player is unsuccessful in winning the progressive award in a first game sequence, absent another triggering event, the gaming system may, based on the player's relative success in the first game sequence, proceed to a second game sequence for additional prospects of winning the same progressive award.

Following any determination to proceed to the progressive award supplemental opportunity sequence, the gaming system determines and displays one or more progressive award supplemental opportunity sequence outcomes, such as one or more symbols or symbol combinations. In this embodiment, the determined and displayed progressive award supplemental opportunity sequence outcomes are selected from a plurality of different progressive award supplemental opportunity sequence outcomes, wherein at least one of the progressive award supplemental opportunity sequence outcomes is associated with the same progressive award which the player did not obtain in the triggered progressive award opportunity sequence.

Following the determination and display of one or more progressive award supplemental opportunity sequence outcomes of the progressive award supplemental opportunity sequence, the gaming system determines, based on one or more determined progressive award supplemental opportunity sequence outcomes, whether to provide the same progressive award to the player. For example, the progressive award supplemental opportunity sequence includes one progressive award supplemental opportunity sequence outcome determination (e.g., one player pick of a plurality of selections wherein one or more of the selections are associated with the progressive award). In this example, if the supplemental progressive award opportunity sequence outcome is associated with the progressive award, the gaming system provides the progressive award to the player (and if the determined progressive award supplemental opportunity sequence outcome is not associated with the progressive award, the gaming system does not provide the progressive award to the player).

Accordingly, the gaming system disclosed herein provides an increased level of excitement and enjoyment to players by providing such players one or more additional chances of winning a progressive award (after unsuccessfully obtaining the progressive award) without having to retrigger the progressive award opportunity sequence. Such a configuration of employing zero, one or more second chance progressive award features thus provides an increased gaming experience for players.

Additional features and advantages are described herein, and will be apparent from the following Detailed Description and the figures.

DETAILED DESCRIPTION

Progressive Award Opportunity Sequences

Figure 1A:
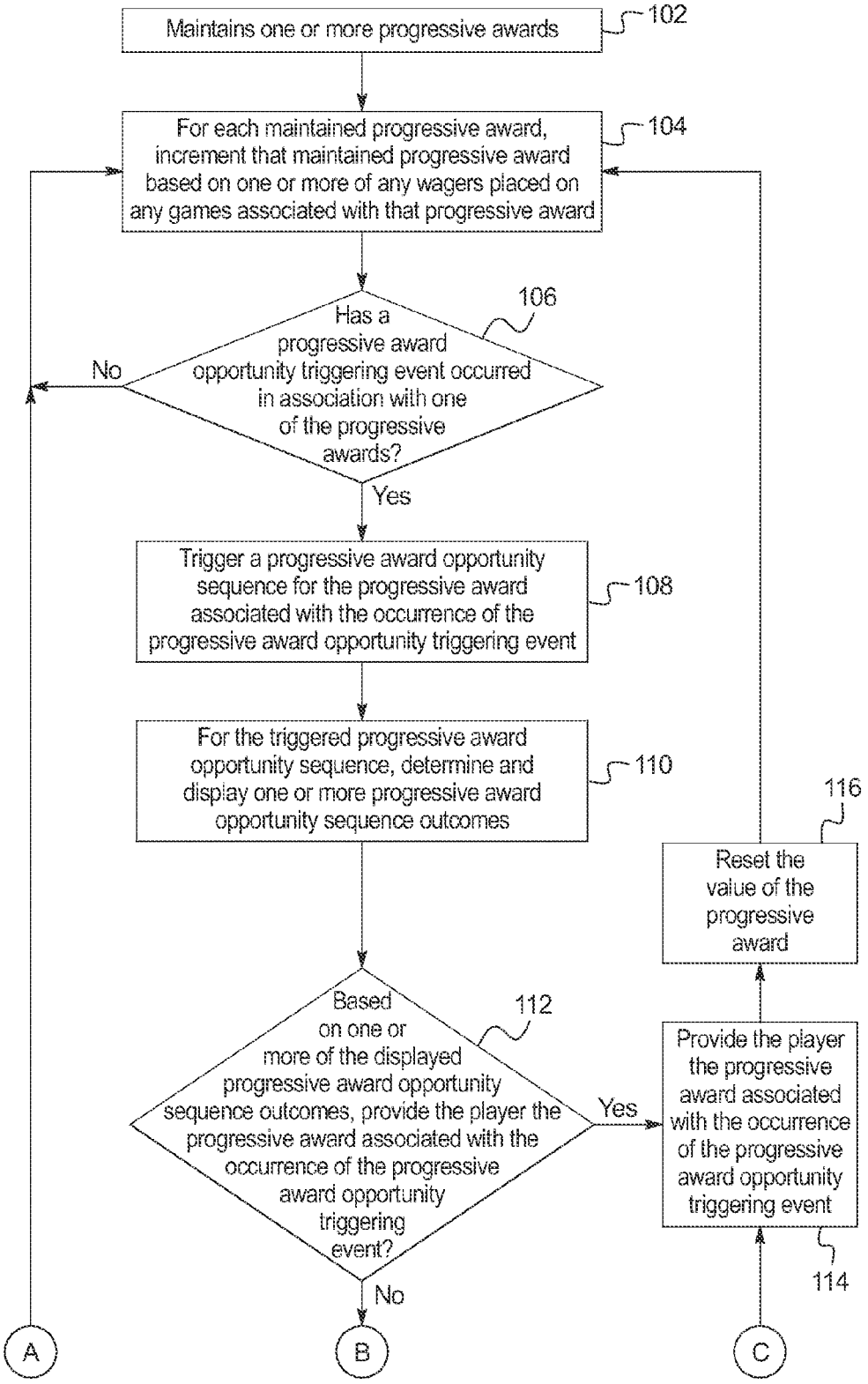
FIGS. 1A and 1B (collectively referred to as FIG. 1) is a flow chart an example process for operating a gaming system including a progressive award opportunity sequence and a progressive award supplemental opportunity sequence. as disclosed herein.

In various embodiments, the gaming system disclosed herein provides a player one or more chances or opportunities to win the same progressive award. Specifically, the gaming system provides the player a first quantity of one or more opportunities to win a progressive award in association with a first game sequence. If the player does not win the progressive award in association with the first game sequence, the gaming system determines whether to provide the player any additional chances or opportunities to win the same progressive award in a second game sequence. In these embodiments, this determination of whether to avail the player to one or more additional opportunities to win the same progressive award is based, at least in part, on one or more events and/or determinations associated with the first game sequence. That is, the gaming system determines, at least partially based on one or more events of a first game sequence: (i) whether to provide a progressive award to a player, and (ii) whether to provide the player zero, one or more additional chances to win the same progressive award in association with a second game sequence. Put differently, in response to one occurrence of a triggering event, the gaming system employs a first game phase including one or more chances to win a progressive award and further employs a second game phase including zero, one or more separate and independent chances to win the same progressive award, wherein the results of the first game phase at least partially determine the player's probability of winning the progressive award in the second game phase (i.e., the results of the first game phase at least partially determine the quantity of progressive award chances of the second game phase). The gaming system disclosed herein is thus configured to provide a player one or more separate and independent chances to obtain the same progressive award in distinct, related game sequences, wherein the quantity of chances provided is based on one or more aspects of the player's gaming experience in at least one of the game sequences. Such a configuration provides an increased level of excitement and enjoyment for certain players because these players enjoy such additional chances to win a progressive award.

While certain of the embodiments described below are directed to winning a progressive award in association with a secondary or bonus game, it should be appreciated that the present disclosure may additionally or alternatively be employed in association with winning a progressive award in association with a primary or base game. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits. Moreover, while one or more game sequences to win a progressive award as disclosed herein are referred to as being executed by a gaming system, such as gaming system includes various configurations of: (a) zero, one or more central servers, central controllers, or remote hosts; (b) zero, one or more electronic gaming machines ("EGMs"); and/or (c) zero, one or more personal gaming devices, such as desktop computers, laptop computers, tablet computers or computing devices, personal digital assistants (PDAs), mobile telephones such as smart phones, and other mobile computing devices.

Figure 1B:
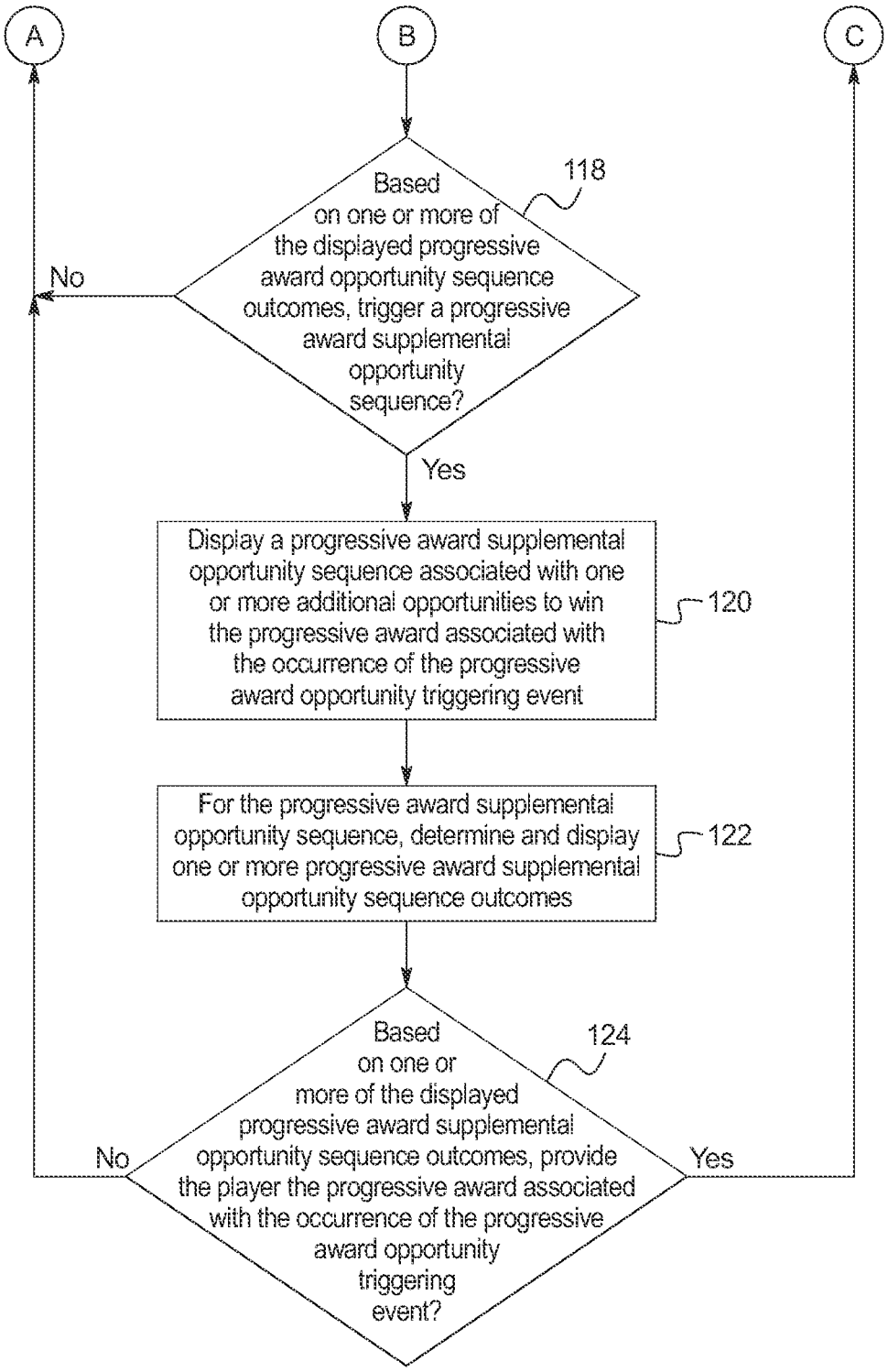

Referring now to FIG. 1, a flowchart of an example embodiment of a process for operating a gaming system disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

Figure 2A:
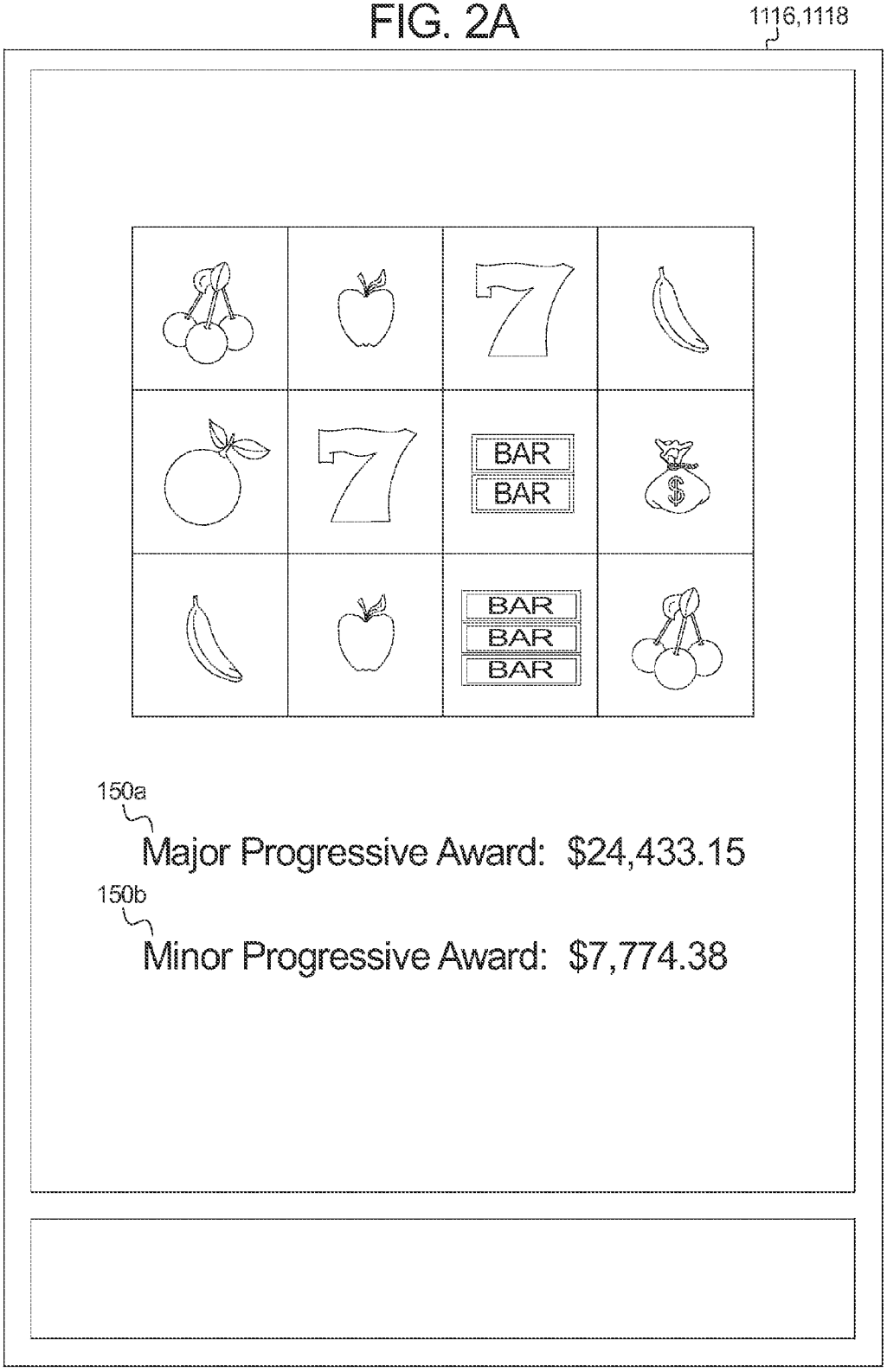
FIGS. 2A, 2B, 2C, 2D, 2E, 2F and 2G are front views of one embodiment of the gaming system disclosed herein illustrating a progressive award opportunity sequence and a progressive award supplemental opportunity sequence.

In various embodiments, the gaming system maintains one or more progressive award as indicated in block 102 of FIG. 1. For example as seen in FIG. 2A, the gaming system maintains a major progressive award 150*a* and a minor progressive award 150*b*. In one embodiment, a plurality of electronic gaming machines ("EGMs") at one or more gaming sites are networked to the central server in a progressive configuration with the at least one maintained progressive award. In another embodiment, a single or stand-alone EGM is associated with or otherwise dedicated to the at least one maintained progressive award. In another embodiment, one or more internet accessible dedicated gaming sites are associated with the at least one maintained progressive award.

For each maintained progressive award, the gaming system increments or grows that maintained progressive award based on one or more of any wagers placed on any games associated with that progressive award as indicated in block 104. In different embodiments, upon each occurrence of a progressive award contribution event (e.g., a placement of a wager, a generation of a designated outcome and/or a gaming establishment marketing event) associated with one of the progressive awards, the gaming system increments or grows that progressive award.

Figure 2B:
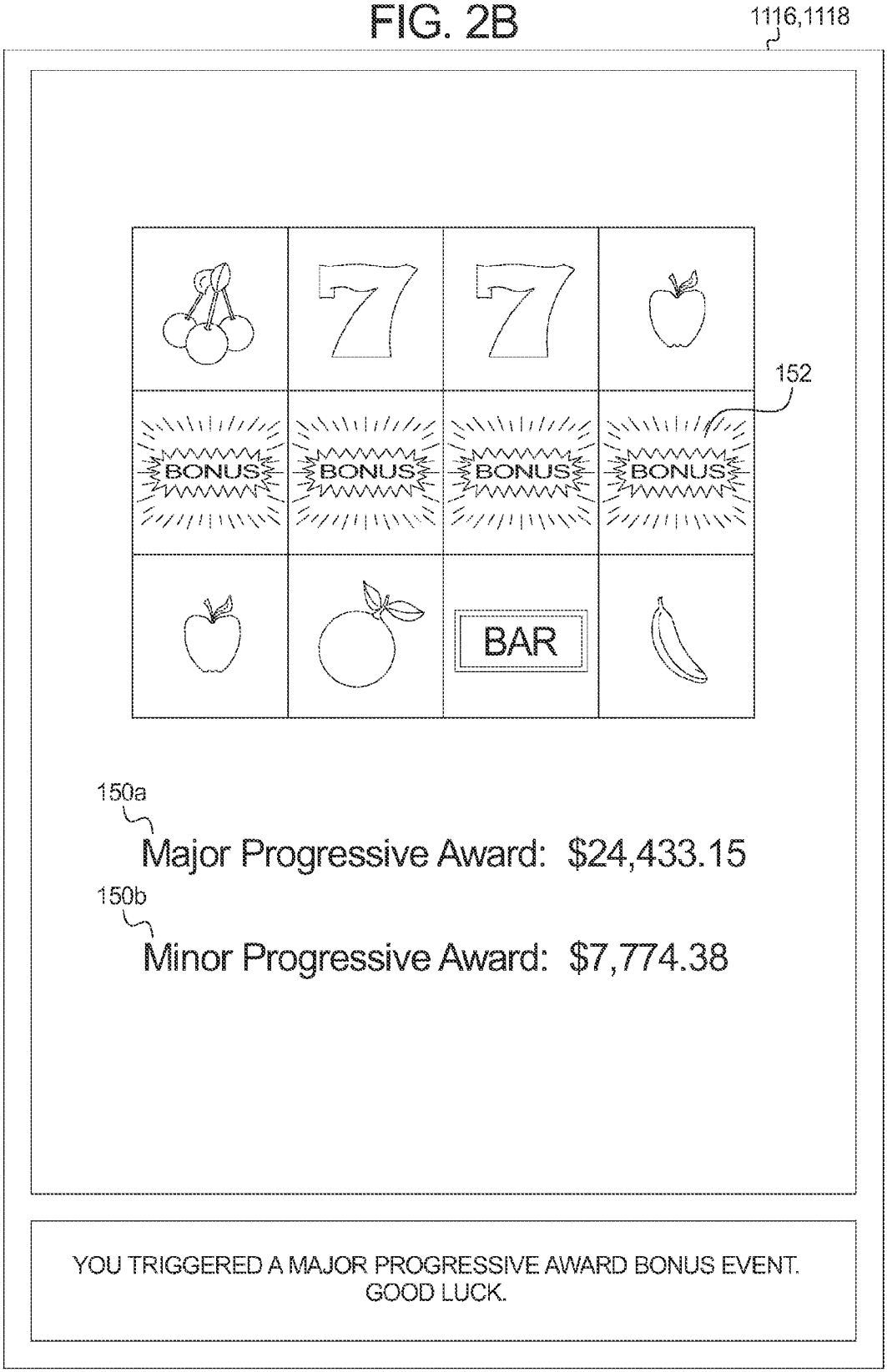

In addition to maintaining and incrementing at least one maintained progressive award, the gaming system monitors for an occurrence of a progressive award opportunity triggering event associated with one of the progressive awards as indicated in diamond 106. In one embodiment, a progressive award opportunity triggering event occurs based on a displayed event in a play of one or more displayed primary games. For example, as seen in FIG. 2B, based on the generation and display of a major progressive award triggering symbol combination 152 in association with a play of a game, the gaming system triggered a progressive award opportunity sequence for the major progressive award. In this example, the gaming system provides appropriate messages such as "YOU TRIGGERED A MAJOR PROGRESSIVE AWARD BONUS EVENT" and "GOOD LUCK" to the player visually, or through suitable audio or audiovisual displays.

In another embodiment, a progressive award opportunity triggering event occurs based on a displayed event in a play of one or more displayed secondary games. In another embodiment, the gaming system tracks the occurrences of one or more suitable events occurring at or in association with one or more players and/or one or more games and determines, based on these tracked events, whether a progressive award opportunity triggering event occurs. In another embodiment, the gaming system defines one or more game play parameters, wherein each time a player's tracked game play activity satisfies the defined parameter, a progressive award opportunity triggering event occurs. In another embodiment, a progressive award opportunity triggering event occurs independent of any displayed event in any play of any game.

If the gaming system determines that no progressive award opportunity triggering event has occurred in association with any progressive award, the gaming system returns to block 104 and continues to increment the maintained progressive award(s) as described above.

On the other hand, if the gaming system determines that a progressive award opportunity triggering event has occurred in association with a maintained progressive award, as indicated in block 108 of FIG. 1, the gaming system triggers a progressive award opportunity sequence in association with that progressive award. As described below, for the progressive award associated with the occurrence of the progressive award opportunity triggering event, the gaming system triggers a first game sequence including one or more opportunities for the player to win that progressive award.

For the triggered progressive award opportunity sequence, the gaming system determines and displays one or more progressive award opportunity sequence outcomes as indicated in block 110 of FIG. 1. The gaming system then determines, as indicated in diamond 112, whether to provide the player the progressive award associated with the occurrence of the progressive award opportunity triggering event, wherein this determination is based on one or more of the displayed progressive award opportunity sequence outcomes.

In one embodiment, the gaming system employs one or more secondary games to determine whether to provide the player the progressive award associated with the occurrence of the progressive award opportunity triggering event. In one such embodiment, the secondary game includes a multi-round selection game wherein each round includes a plurality of player pickable selections. In this embodiment, one or more of the selections are associated with a progressive award outcome, wherein the determination of whether or not the gaming system provides the player the progressive award is based on whether such player picked selections are associated with the progressive award. Specifically, the gaming system determines if a quantity of player picked selections associated with the progressive award reach a winning progressive award outcome threshold. In this example, if the gaming system determines that the quantity of player picked selections associated with the progressive award reaches the winning progressive award outcome threshold, the gaming system provides the player the progressive award associated with the occurrence of the progressive award opportunity triggering event. On the other hand, if the gaming system determines that the quantity of player picked selections associated with the progressive award does not reach the winning progressive award outcome threshold, the gaming system does not provide the player the progressive award associated with the occurrence of the progressive award opportunity triggering event.

Figure 2C:
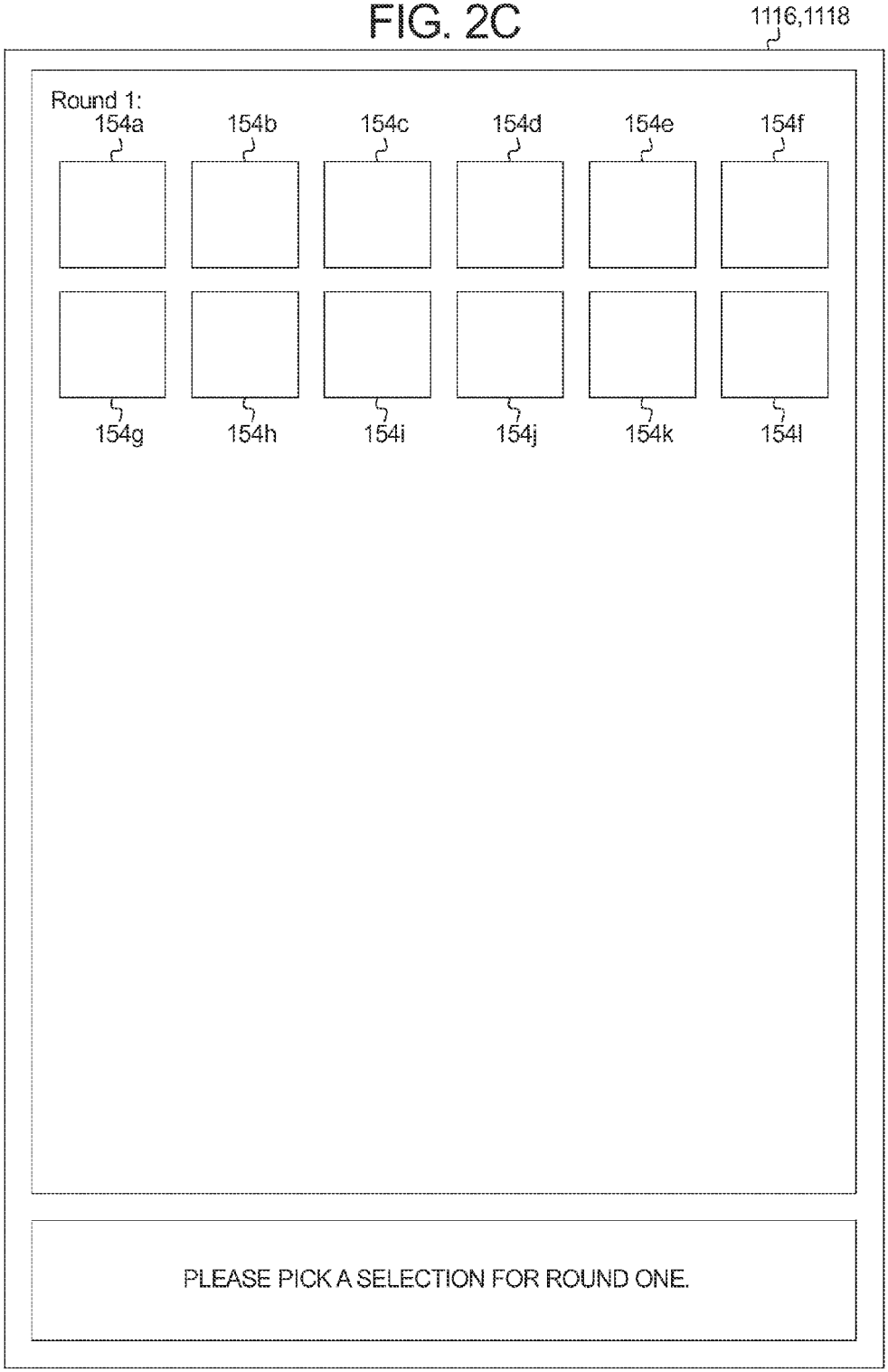

For example, as seen in FIG. 2C, the gaming system displays the triggered progressive award opportunity sequence as a three round selection game. In this example, for each round, the selection game includes a plurality of masked selections 154 wherein one or more of the selections are associated with the played for progressive award represented by a progressive award symbol 156. In operation of this example, for each round, the gaming system enables the player to pick one of the selections. In this example, the gaming system provides appropriate messages such as "PLEASE PICK A SELECTION FOR ROUND ONE" to the player visually, or through suitable audio or audiovisual displays.

Figure 2D:
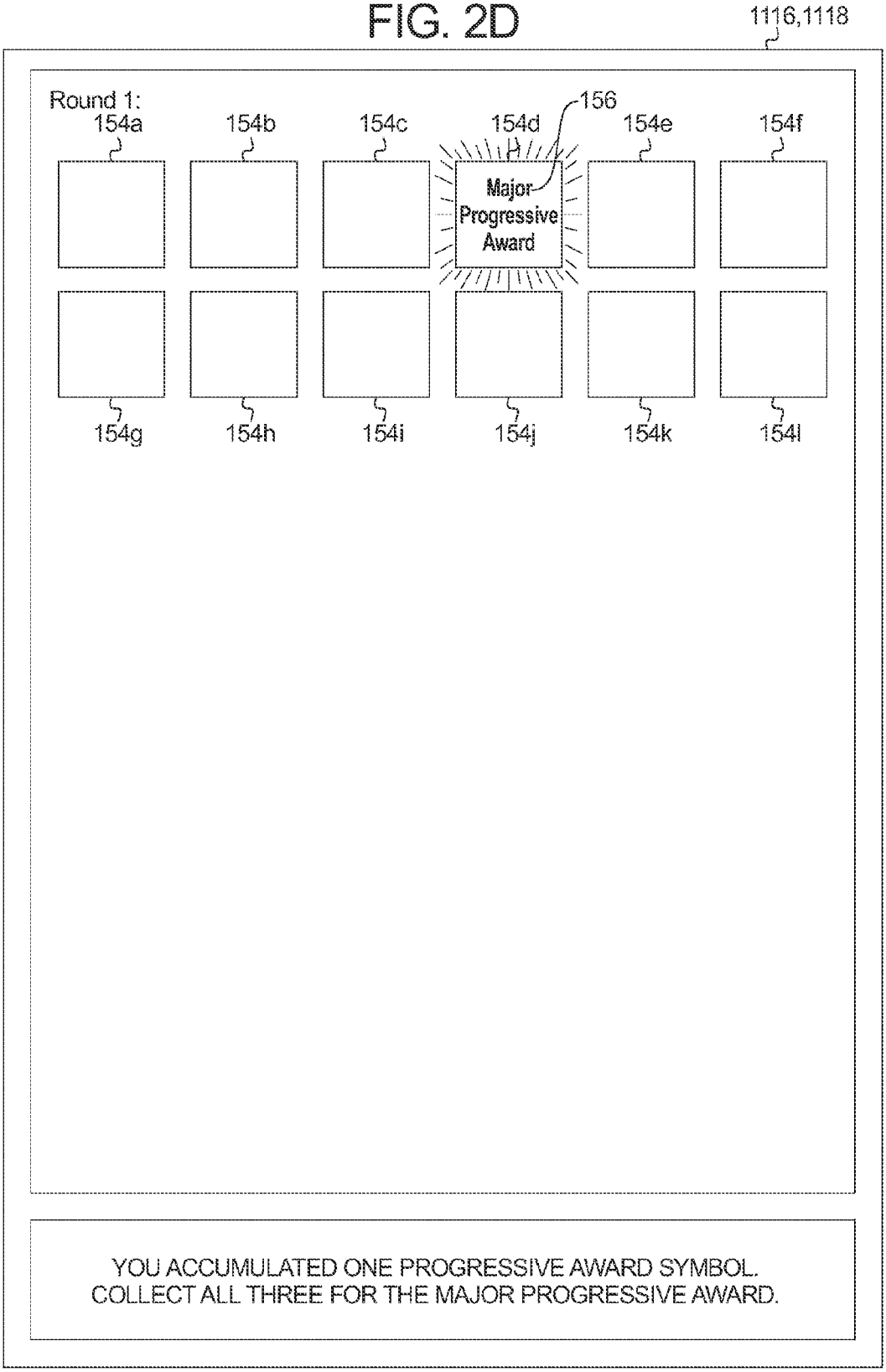

As seen in FIG. 2D, the player picked selection 154*d* which the gaming system revealed or displayed to be associated with the played for major progressive award symbol 156. In this example, the gaming system provides appropriate messages such as "YOU ACCUMULATED ONE PROGRESSIVE AWARD SYMBOL" and "COLLECT ALL THREE FOR THE MAJOR PROGRESSIVE AWARD" to the player visually, or through suitable audio or audiovisual displays.

Figure 2E:
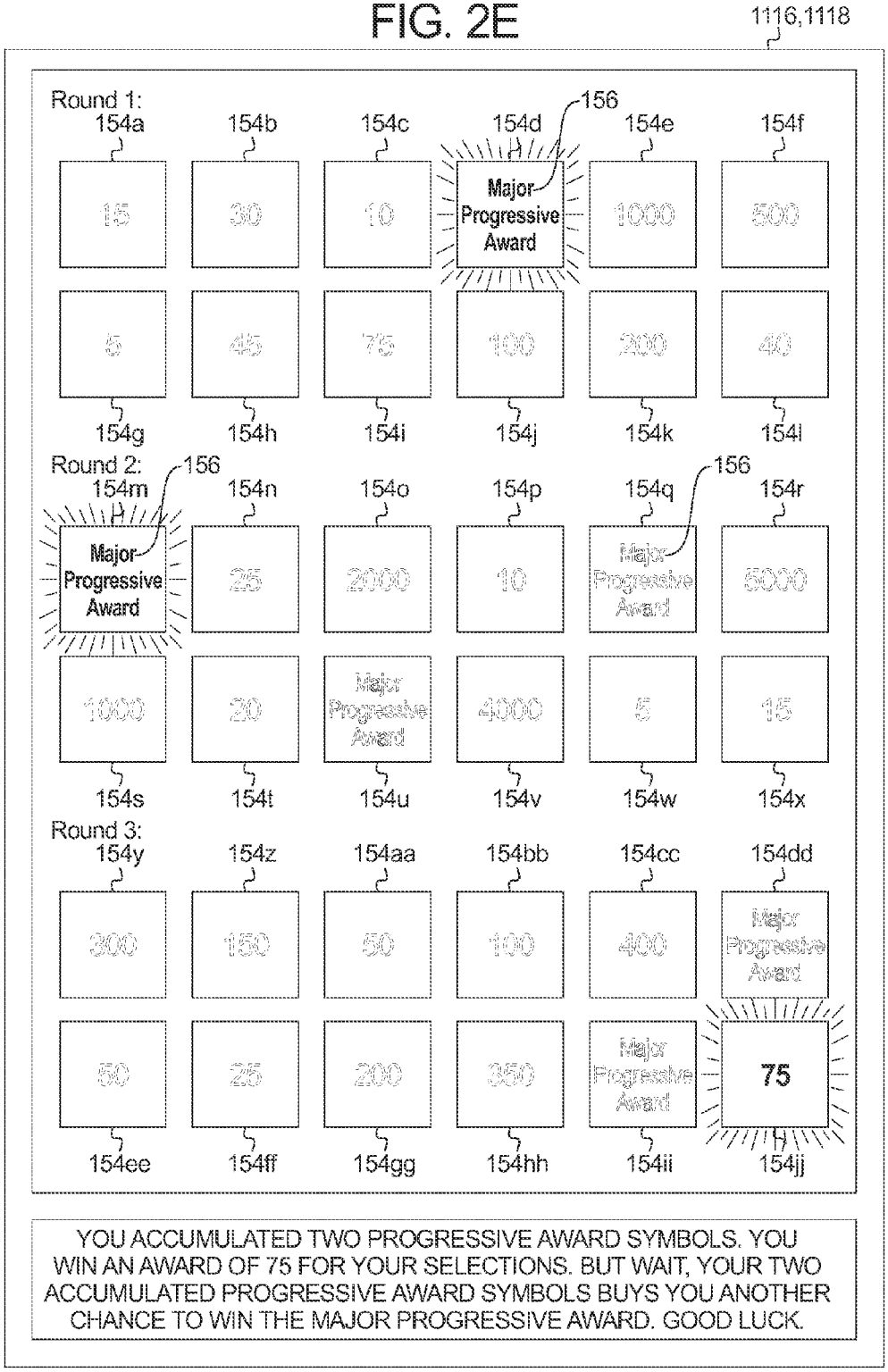

As seen in FIG. 2E, following the completion of the third and final round of the selection game and the display of another selection associated with the played for major progressive award, the gaming system determines not to provide the played for progressive award to the player. In this example, since each of the player picked selections were not associated with the played for major progressive award (i.e., the two player picked selections associated with the played for major progressive award did not reach the winning progressive award outcome threshold of three player picked selections associated with the progressive award), the gaming system does not provide the player the played for major progressive award. In this example, the gaming system provides appropriate messages such as "YOU ACCU- MULATED TWO PROGRESSIVE AWARD SYMBOLS" and "YOU WIN AN AWARD OF 75 FOR YOUR SELECTIONS" to the player visually, or through suitable audio or audiovisual displays.

Returning to FIG. 1, if the gaming system determines to provide the player the progressive award associated with the occurrence of the progressive award opportunity triggering event, as indicated in blocks 114 and 116, the gaming system provides the player the progressive award associated with the occurrence of the progressive award opportunity triggering event and resets the value of the provided progressive award. The gaming system then returns to block 104 and continues to increment the maintained progressive award(s) as described above.

On the other hand, if the gaming system determines not to provide the player the progressive award associated with the occurrence of the progressive award opportunity triggering event, as indicated in diamond 118, the gaming system determines whether to trigger a progressive award supplemental opportunity sequence. As further indicated in diamond 118, this determination is based on one or more of the progressive award opportunity sequence outcomes determined in association with the triggered progressive award opportunity sequence. Accordingly, based on the progressive award opportunity sequence outcomes of the triggered progressive award sequence, the gaming system first determines whether to provide a progressive award to a player and further determines (if the first determination is not to provide the progressive award) whether to provide any additional chances or opportunities to win the same progressive award in a progressive award supplemental opportunity sequence.

If the gaming system determines not to trigger a progressive award supplemental opportunity sequence, the gaming system returns to block 104 and continues to increment the maintained progressive award(s) as described above. On the other hand, if the gaming system determines to trigger a progressive award supplemental opportunity sequence, the gaming system proceeds to display a progressive award supplemental opportunity sequence associated with one or more additional opportunities to win the progressive award associated with the occurrence of the progressive award opportunity triggering event as indicated in block 120. That is, the gaming system determines, at least partially based on one or more events or outcomes of a first game sequence: (i) whether to provide a progressive award to a player, and (ii) whether to provide the player zero, one or more additional chances to win the same progressive award in association with a second game sequence. Put differently, in response to one occurrence of a triggering event, the gaming system employs a first game phase including one or more chances to win a progressive award and further employs a second game phase including zero, one or more chances to win the same progressive award, wherein the results of the first game phase at least partially determine the player's probability of winning the progressive award in the second game phase. Accordingly, even if the player is unsuccessful in winning the progressive award in a first game sequence, the gaming system may, based on the player's relative success in the first game sequence, proceed to a second game sequence for additional prospects of winning the same progressive award.

In one embodiment, the determination of whether to proceed to a progressive award supplemental opportunity sequence is based on a quantity of determined and displayed progressive award opportunity sequence outcomes associated with the progressive award. In this embodiment, if the gaming system determines that the quantity of progressive award opportunity sequence outcomes associated with the played for progressive award reaches an additional opportunity progressive award outcome threshold, the gaming system determines to proceed to a progressive award supplemental opportunity sequence to play for the same progressive award. On the other hand, if the gaming system determines that the quantity of progressive award opportunity sequence outcomes associated with the played for progressive award does not reach the additional opportunity progressive award outcome threshold, the gaming system does not proceed to the progressive award supplemental opportunity sequence and thus does not enable the player to play for the same progressive award (absent another occurrence of the progressive award opportunity triggering event).

For example, as seen in FIG. 2E, after determining not to provide the progressive award to the player for the triggered progressive award opportunity sequence, the gaming system determines that since two player picked selections were associated with the played for major progressive award and the additional opportunity progressive award outcome threshold of two picked selections associated with the progressive award was satisfied, the gaming system proceeds to a progressive award supplemental opportunity sequence. In this example, the gaming system provides appropriate messages such as "BUT WAIT, YOUR TWO ACCUMULATED PROGRESSIVE AWARD SYMBOLS BUYS YOU ANOTHER CHANCE TO WIN THE MAJOR PROGRESSIVE AWARD" and "GOOD LUCK" to the player visually, or through suitable audio or audiovisual displays.

As seen in block 122 of FIG. 1, for the progressive award supplemental opportunity sequence, gaming system determines and displays one or more progressive award supplemental opportunity sequence outcomes. The gaming system then determines, as indicated in diamond 124, whether to provide the player the progressive award associated with the occurrence of the progressive award opportunity triggering event, wherein this determination is based on one or more of the displayed progressive award supplemental opportunity sequence outcomes.

If the gaming system determines to provide the player the progressive award associated with the occurrence of the progressive award opportunity triggering event, as indicated in blocks 114 and 116, the gaming system provides the player the progressive award associated with the occurrence of the progressive award opportunity triggering event and resets the value of the provided progressive award. The gaming system then returns to block 104 and continues to increment the maintained progressive award(s) as described above. On the other hand, if the gaming system determines not to provide the player the progressive award associated with the occurrence of the progressive award opportunity triggering event, the gaming system returns to block 104 and continues to increment the maintained progressive award(s) as described above.

Figure 2F:
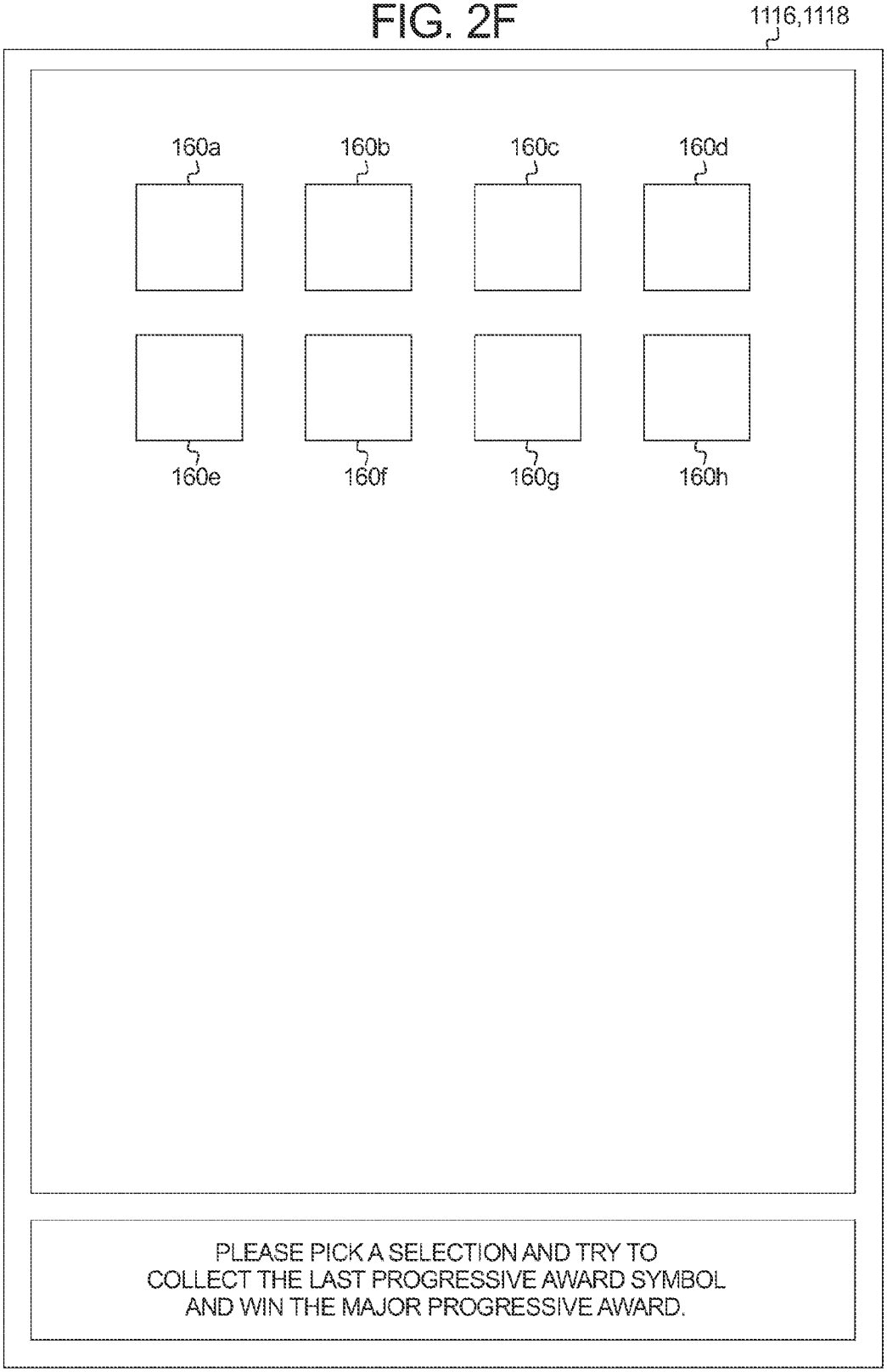

In one embodiment, the gaming system employs one or more secondary games to determine whether to provide the player the progressive award for the progressive award supplemental opportunity sequence. In one such embodiment, the secondary game includes a selection game including a plurality of player pickable selections. In this embodiment, one or more of the selections are associated with a progressive award outcome, wherein the determination of whether or not the gaming system provides the player the progressive award is based on whether one or more of such player picked selections are associated with the progressive award outcome. For example, as seen in FIG. 2F, the gaming system displays the progressive award supplemental opportunity sequence as a selection game including a plurality of masked selections 160 wherein one or more of the selections are associated with the played for progressive award. In operation of this example, the gaming system enables the player to pick one of the selections. In this example, the gaming system provides appropriate messages such as "PLEASE PICK A SELECTION AND TRY TO COLLECT THE LAST PROGRESSIVE AWARD SYMBOL AND WIN THE MAJOR PROGRESSIVE AWARD" to the player visually, or through suitable audio or audiovisual displays.

Figure 2G:
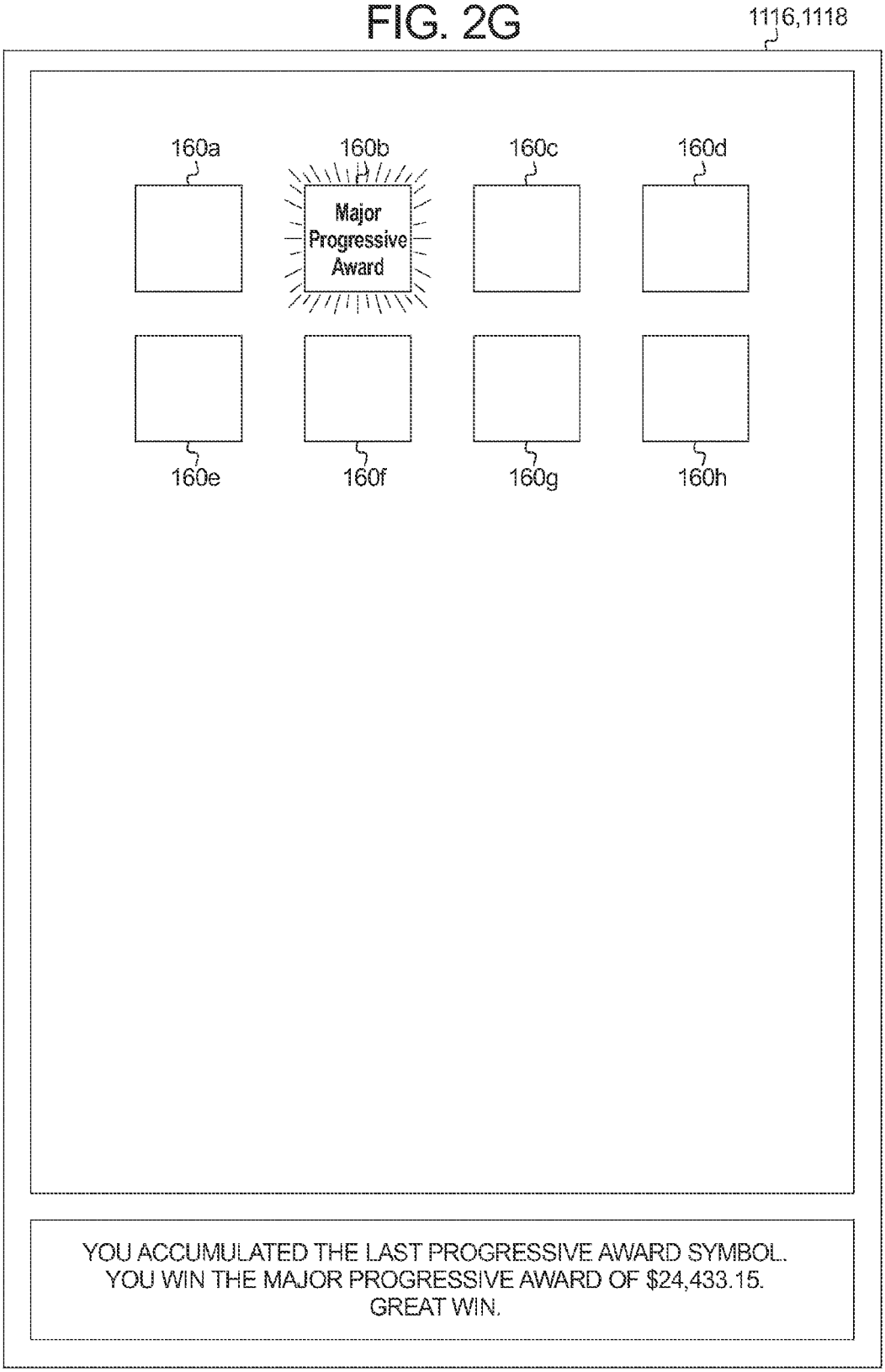

As seen in FIG. 2G, the player picked selection 160*b* which the gaming system revealed or displayed to be associated with the played for major progressive award symbol 156. In this example, the gaming system provides appropriate messages such as "YOU ACCUMULATED THE LAST PROGRESSIVE AWARD SYMBOL", "YOU WIN THE MAJOR PROGRESSIVE AWARD OF $24, 433.15" and "GREAT WIN" to the player visually, or through suitable audio or audiovisual displays.

In one embodiment wherein the gaming system maintains a plurality of progressive awards (e.g., a plurality of separate progressive awards or a plurality of progressive awards of a multi-level progressive award ("MLP") configuration), two or more of such progressive awards start at different levels and increment or increase until provided to a player. In various embodiments, each of the progressive awards is associated with a progressive award contribution rate which represents the portion of each wager placed (or the portion of each designated wager, such as a maximum wager, placed) that is allocated to the progressive award. In one such embodiment wherein the gaming system maintains a plurality of progressive awards, two or more of such progressive awards have different progressive award contribution rates.

In one embodiment, as described above, if a progressive award opportunity triggering event occurs, the gaming system triggers a progressive award opportunity sequence and determines whether to provide the player the progressive award associated with the occurrence of the progressive award opportunity triggering event. In another embodiment, a plurality of progressive awards are each associated with a progressive award opportunity triggering event wherein if a progressive award opportunity triggering event occurs, the gaming system triggers a progressive award opportunity sequence and determines whether to provide the player each of the progressive awards associated with the occurrence of the progressive award opportunity triggering event. In one such embodiment, the gaming system separately determines, for each of the progressive awards associated with the occurrence of the progressive award opportunity triggering event, whether to provide that progressive award to the player (i.e., the gaming system provides the player a plurality of progressive award opportunity sequences wherein each progressive award opportunity sequence is for a separate progressive award). In another such embodiment, the gaming system determines, for each of the progressive awards associated with the occurrence of the progressive award opportunity triggering event, whether to provide that progressive award to the player (i.e., the gaming system provides the player a progressive award opportunity sequence including at least one separate determination for each of the plurality of progressive awards).

In one embodiment, as illustrated in the above example, even if the gaming system does not provide the player the played for progressive award in association with one of the triggered progressive award opportunity sequence and/or any progressive award supplemental opportunity sequence, the gaming system provides the player an alternative award, such as one or more non-progressive awards associated with one or more progressive award opportunity sequence outcomes and/or progressive award supplemental opportunity sequence outcomes. In this embodiment, one or more of the progressive award opportunity sequence outcomes and/or any progressive award supplemental opportunity sequence outcomes are associated with one or more awards which the gaming system provides to the player. In another embodiment, the gaming system provides a player either a progressive award or no award in association with the progressive award opportunity sequence and/or any progressive award supplemental opportunity sequence.

In another embodiment, the progressive award opportunity sequence and/or any progressive award supplemental opportunity sequence are employed as part of a game (played either as primary game or a secondary game) which enables a player to place one or more wagers on one or more outcomes. In one example embodiment of this game (not shown), upon an occurrence of a progressive award opportunity sequence triggering event, the gaming system displays a betting screen including: (i) a standard deck of fifty-two playing cards, (ii) a plurality of betting areas for a plurality of playing card ranks (i.e., an Ace playing card betting area, a two playing card betting area, a three playing card betting area), (iii) a plurality of betting areas for a plurality of playing card suits (i.e., a diamond playing card suit betting area, a club playing card suit betting area, a heart playing card suit betting area and a spade playing card suit betting area), (iv) a plurality of betting areas for a plurality of playing card colors (i.e., a red playing card betting area and a black playing card betting area), (v) a quantity of betting tokens, such as four betting tokens, and (vi) a playing card history board.

In this example, the gaming system enables the player to place the betting tokens at one or more of the betting areas. Following this betting activity, for each of a plurality of rounds, the gaming system enables the player to select a playing card from the displayed deck of playing cards. The gaming system of this example reveals the selected playing card, updates the playing card history board accordingly and resolves any placed bets based on the revealed selected playing card. In this example, based on the revealed selected playing card: (i) one of the playing card ranks will be a winner (which the gaming system pays out at a first award amount, such as one-thousand-three hundred credits, per token wagered on the winning playing card rank), (ii) one of the playing card suits will be a winner (which the gaming system pays out at a second award amount, such as four-hundred credits, per token wagered on the winning playing card suit), and (iii) one of the player card colors will be a winner (which the gaming system pays out at a third award amount, such as two-hundred credits, per token wagered on the winning playing card color).

It should be appreciated that such a secondary game enables a player to play the secondary game based on a plurality of different betting styles. For example, if a player is relatively conservative, the player could bet two tokens on the red playing card color, one token on the black playing card color and one token on the club playing card suit. In this example, based on the example award amounts described above, if any spade playing card is selected (which has a 25% of occurring for one draw from any complete playing card deck), the player wins four-hundred credits; if any club playing card is selected (which has a 25% of occurring for one draw from any complete playing card deck), the player wins four-hundred credits; and if any red playing card is selected (which has a 50% of occurring for one draw from any complete playing card deck), the player wins four-hundred credits. In another example, if a player is relatively aggressive, the player could bet four tokens on the Ace playing card. In this example, if any ace playing card is selected (which has a 7.7% of occurring for one draw from any complete playing card deck), based on the example award amounts described above, the player wins five-thousand-two-hundred credits and if any non-ace playing card is selected (which has a 92.3% of occurring for one draw from any complete playing card deck), the player wins zero credits. In another example, if a player bets one token on the red playing card color, one token on the spade playing card suit, one token on the Ace playing card and one token on the playing card rank of five. In this example, based on the example award amounts described above, if a Queen of spades playing card is selected (which has a 1.9% of occurring for one draw from any complete playing card deck), the player wins one-thousand-seven-hundred credits; if a red colored Queen playing card is selected (which has a 3.8% of occurring for one draw from any complete playing card deck), the player wins one-thousand-five-hundred credits; if a Queen of clubs playing card is selected (which has a 1.9% of occurring for one draw from any complete playing card deck), the player wins one-thousand-three-hundred credits; if a five of spades playing card is selected (which has a 1.9% of occurring for one draw from any complete playing card deck), the player wins one-thousand-seven-hundred credits; if a red colored five playing card is selected (which has a 3.8% of occurring for one draw from any complete playing card deck), the player wins one-thousand-five-hundred credits; if a five of clubs playing card is selected (which has a 1.9% of occurring for one draw from any complete playing card deck), the player wins one-thousand-three-hundred credits; if any playing card except a five playing card and except the Queen of spades playing card is selected (which has a 21.1% of occurring for one draw from any complete playing card deck), the player wins four hundred credits; if any playing card except a five playing card and except a red colored Queen playing card is selected (which has a 42.3% of occurring for one draw from any complete playing card deck), the player wins two hundred credits; and if any playing card except a five playing card and the Queen of clubs playing card is selected (which has a 21.1% of occurring for one draw from any complete playing card deck), the player wins zero credits.

In one example embodiment, the gaming system employs the progressive award opportunity sequence and any progressive award supplemental opportunity sequence as part of this token wagering game. In this embodiment, for each of the rounds, the gaming system utilizes one or more progressive award sub-symbols (on one or more playing cards) for one or more maintained progressive awards. For example, for each playing card draw, a major progressive award sub-symbol is associated with two playing cards, six playing cards and three playing cards during rounds one, two and three, respectively. In this example, each drawn playing card associated with a major progressive award sub-symbol is associated with an award of seventy-five credits. Moreover, in this example, if the player collects three playing cards that are each associated with the major progressive award sub-symbol (i.e., the winning progressive award outcome threshold of the triggered progressive award opportunity sequence for the major progressive award is reached), the gaming system provides the player the major progressive award. On the other hand, if the player collects two playing cards that are each associated with the major progressive award sub-symbol (i.e., the winning progressive award outcome threshold of the triggered progressive award opportunity sequence for the major progressive award is not reached, but the additional opportunity progressive award outcome threshold for the major progressive award is reached), the gaming system proceeds to a last chance progressive award supplemental opportunity sequence. In the last chance progressive award supplemental opportunity sequence, the gaming system enables the player to pick a card from a deck including seven playing cards and one major progressive award card. If the player picks the major progressive award card, the gaming system provides the major progressive award to the player. If the player picks any other playing card, the gaming system does not provide the major progressive award to the player (but rather provides another non-progressive award to the player). In this example, the gaming system provides the player a 1.25% of winning the major progressive award in association with the token wagering game. Additionally, in this example, if the player collects zero or one playing cards that are each associated with the major progressive award sub-symbol (i.e., the winning progressive award outcome threshold of the triggered progressive award opportunity sequence for the major progressive award is not reached and the additional opportunity progressive award outcome threshold for the major progressive award is not reached), the gaming system proceeds to a non-progressive additional award sequence. In the non-progressive additional award sequence, the gaming system enables the player to pick a card from a deck including seven playing cards (not including any major progressive award cards), wherein the gaming system provides the player a non-progressive award associated with the picked playing card.

In another example, additional or alternatively to enabling the player to play for the major progressive award as part of the token wagering game, the gaming system enables the player to play for the minor progressive award as part of the token wagering game. For example, for each playing card draw, a minor progressive award sub-symbol is associated with twenty-five playing cards, twenty-one playing cards and fourteen playing cards during rounds one, two and three, respectively. In this example, each drawn playing card associated with a minor progressive award sub-symbol is associated with an award of twenty-five credits. Moreover, in this example, if the player collects three playing cards that are each associated with the minor progressive award sub-symbol (i.e., the winning progressive award outcome threshold of the triggered progressive award opportunity sequence for the minor progressive award is reached), the gaming system provides the player the minor progressive award. On the other hand, if the player collects two playing cards that are each associated with the minor progressive award sub-symbol (i.e., the winning progressive award outcome threshold of the triggered progressive award opportunity sequence for the minor progressive award is not reached, but the additional opportunity progressive award outcome threshold for the minor progressive award is reached), the gaming system proceeds to a last chance progressive award supplemental opportunity sequence. In the last chance progressive award supplemental opportunity sequence, the gaming system enables the player to pick a card from a deck including seven playing cards and one minor progressive award card. If the player picks the minor progressive award card, the gaming system provides the minor progressive award to the player. If the player picks any other playing card, the gaming system does not provide the minor progressive award to the player (but rather provides another non-progressive award to the player). In this example, the gaming system provides the player a 27.8% of winning the minor progressive award in association with the token wagering game. Additionally, in this example, if the player collects zero or one playing cards that are each associated with the minor progressive award sub-symbol (i.e., the winning progressive award outcome threshold of the triggered progressive award opportunity sequence for the minor progressive award is not reached and the additional opportunity progressive award outcome threshold for the minor progressive award is not reached), the gaming system proceeds to a non-progressive additional award sequence. In the non-progressive additional award sequence, the gaming system enables the player to pick a card from a deck including seven playing cards (not including any minor progressive award cards), wherein the gaming system provides the player a non-progressive award associated with the picked playing card.

In one embodiment, for the triggered progressive award opportunity sequence and/or any progressive award supplemental opportunity sequence, the gaming system employs a weighted table to determine whether to provide the player the progressive award associated with the occurrence of the progressive award opportunity triggering event. In another embodiment, for the triggered progressive award opportunity sequence and/or any progressive award supplemental opportunity sequence, the gaming system employs a secondary game including a progressive award generator. In this embodiment, the progressive award generator spins and any progressive award symbols indicated by an indicator determine whether to provide the player the progressive award associated with the occurrence of the progressive award opportunity triggering event. In another embodiment, for the triggered progressive award opportunity sequence and/or any progressive award supplemental opportunity sequence, the gaming system employs a secondary game including a progressive award reel. In this embodiment, the progressive award reel spins and any progressive award symbols generated along a payline determine whether to provide the player the progressive award associated with the occurrence of the progressive award opportunity triggering event. In another embodiment, for the triggered progressive award opportunity sequence and/or any progressive award supplemental opportunity sequence, the gaming system employs a secondary game including a game of skill wherein the determination of whether to provide the player the progressive award associated with the occurrence of the progressive award opportunity triggering event corresponds to the player's performance as compared to a baseline performance level of the skill game. It should be appreciated that any suitable secondary game may be employed in association with determining whether to provide the player the progressive award associated with the occurrence of the progressive award opportunity triggering event.

In different embodiments, one or more progressive award opportunity sequences and/or one or more progressive award supplemental opportunity sequences include, but are not limited to:

i. a play of any suitable slot game;
ii. a play of any suitable free spins or free game activations;
iii. a play of any suitable wheel game;
iv. a play of any suitable card game;
v. a play of any suitable offer and acceptance game;
vi. a play of any suitable award ladder game;
vii. a play of any suitable puzzle-type game;
viii. a play of any suitable persistence game;
ix. a play of any suitable selection game;
x. a play of any suitable cascading symbols game;
xi. a play of any suitable ways to win game;
xii. a play of any suitable scatter pay game;
xiii. a play of any suitable coin-pusher game;
xiv. a play of any suitable elimination game;
xv. a play of any suitable stacked wilds game;
xvi. a play of any suitable trail game;
xvii. a play of any suitable bingo game;
xviii. a play of any suitable video scratch-off game;
xix. a play of any suitable pick-until-complete game;
xx. a play of any suitable shooting simulation game;
xxi. a play of any suitable racing game;
xxii. a play of any suitable promotional game;
xxiii. a play of any suitable high-low game;
xxiv. a play of any suitable lottery game;
xxv. a play of any suitable number selection game;
xxvi. a play of any suitable dice game;
xxvii. a play of any suitable skill game;
xxviii. a play of any suitable auction game;
xxix. a play of any suitable reverse-auction game;
xxx. a play of any suitable group game;
xxxi. a play of any suitable game in a service window;
xxxii. a play of any suitable game on a mobile device; and/or
xxxiii. a play of any suitable game disclosed herein.

In different embodiments, one or more awards provided in association with one or more primary game plays, one or more secondary game plays, one or more progressive award opportunity sequences and/or one or more progressive award supplemental opportunity sequences include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product such as a free teddy bear, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on an internet.

In one embodiment, the gaming system causes at least one display device of at least one electronic gaming machine to display any sequences associated with winning a progressive award. In another embodiment, in addition or in alternative to each electronic gaming machine displaying any sequences associated with winning a progressive award, the gaming system causes one or more community or overhead display devices to display part or all of any sequences associated with winning a progressive award to one or more other players or bystanders either at a gaming establishment or viewing over a network, such as the internet. In another embodiment, in addition or in alternative to each electronic gaming machine displaying any sequences associated with winning a progressive award, the gaming system causes one or more internet sites to each display any sequences associated with winning a progressive award such that a player is enabled to log on from a personal web browser. In another such embodiment, the gaming system enables the player to play one or more games on one device while viewing any sequences associated with winning a progressive award from another device, such as a desktop or laptop computer.

In different embodiments, a progressive award opportunity triggering event occurs based on an outcome associated with one or more plays of any primary games. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes such conditions to be satisfied and/or one or more of such events to occur.

In different embodiments, the gaming system does not provide any apparent reasons to the players for an occurrence of a progressive award opportunity triggering event. In these embodiments, such determinations are not triggered by an event in a primary game or based specifically on any of the plays of any primary games. That is, these events occur without any explanation or alternatively with simple explanations.

In one such embodiment, a progressive award opportunity triggering event occurs based on an amount of coin-in. In this embodiment, the gaming system determines if an amount of coin-in reaches or exceeds a designated amount of coin-in (i.e., a threshold coin-in amount). Upon the amount of coin-in wagered reaching or exceeding the threshold coin-in amount, the gaming system causes one or more of such events or conditions to occur. In another such embodiment, a progressive award opportunity triggering event occurs based on an amount of virtual currency-in. In this embodiment, the gaming system determines if an amount of virtual currency-in wagered reaches or exceeds a designated amount of virtual currency-in (i.e., a threshold virtual currency-in amount). Upon the amount of virtual currency-in wagered reaching or exceeding the threshold virtual currency-in amount, the gaming system causes one or more of such events or conditions to occur. In different embodiments, the threshold coin-in amount and/or the threshold virtual currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In one such embodiment, a progressive award opportunity triggering event occurs based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes one or more of such events or conditions to occur. In another such embodiment, a progressive award opportunity triggering event occurs based on an amount of virtual currency-out. In this embodiment, the gaming system determines if an amount of virtual currency-out reaches or exceeds a designated amount of virtual currency-out (i.e., a threshold virtual currency-out amount). Upon the amount of virtual currency-out reaching or exceeding the threshold virtual currency-out amount, the gaming system causes one or more of such events or conditions to occur. In different embodiments, the threshold coin-out amount and/or the threshold virtual currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In different embodiments, a progressive award opportunity triggering event occurs based on a predefined variable reaching a defined parameter threshold. For example, when the 500,000$^{th}$ player has played an electronic gaming machine (ascertained from a player tracking system), one or more of such events or conditions occur. In different embodiments, the predefined parameter thresholds include a length of time, a length of time after a certain dollar amount is hit, a wager level threshold for a specific device (which electronic gaming machine is the first to contribute $250,000), a number of electronic gaming machines active, or any other parameter that defines a suitable threshold.

In different embodiments, a progressive award opportunity triggering event occurs based on a quantity of games played. In this embodiment, a quantity of games played is set for when one or more of such events or conditions will occur. In one embodiment, such a set quantity of games played is based on historic data.

In different embodiments, a progressive award opportunity triggering event occurs based on time. In this embodiment, a time is set for when one or more of such events or conditions will occur. In one embodiment, such a set time is based on historic data.

In different embodiments, a progressive award opportunity triggering event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the electronic gaming machine. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In different embodiments, a progressive award opportunity triggering event occurs based on a system determination, including one or more random selections by the central controller. In one embodiment, as described above, the gaming system tracks all active electronic gaming machines and the wagers they placed. In one such embodiment, based on the electronic gaming machine's state as well as one or more wager pools associated with the electronic gaming machine, the gaming system determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In different embodiments, a progressive award opportunity triggering event occurs based on a determination of if any numbers allotted to an electronic gaming machine match a randomly selected number. In this embodiment, upon or prior to each play of each electronic gaming machine, an electronic gaming machine selects a random number from a range of numbers and during each primary game, the electronic gaming machine allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a progressive award opportunity triggering event to occur may be implemented in accordance with the gaming system and method disclosed herein.

It should be appreciated that one or more of the above-described triggers pertaining to a progressive award opportunity triggering event occurring may be combined in one or more different embodiments.

Alternative Embodiments

It should be appreciated that in different embodiments, one or more of:

i. a quantity of maintained progressive awards;
ii. one or more reset values of one or more progressive awards;
iii. one or more contribution rates of one or more progressive awards;
iv. when a progressive award opportunity triggering event occurs;
v. a type of progressive award opportunity sequence to trigger;
vi. a quantity of progressive awards to enable the player to play for in a progressive award opportunity sequence;
vii. which progressive award(s) to enable the player to play for in a progressive award opportunity sequence;
viii. a quantity of chances to enable the player to win the progressive award in a progressive award opportunity sequence;
ix. whether to provide a player a progressive award in association with a progressive award opportunity sequence;
x. whether to proceed to a progressive award supplemental opportunity sequence;
xi. a type of progressive award supplemental opportunity sequence to proceed to;
xii. a quantity of progressive awards to enable the player to continue to play for in a progressive award supplemental opportunity sequence;
xiii. which progressive award(s) to enable the player to continue to play for in a progressive award supplemental opportunity sequence;
xiv. a quantity of addition chances to enable the player to win the progressive award in a progressive award supplemental opportunity sequence;
xv. whether to provide a player a progressive award in association with a progressive award supplemental opportunity sequence; and/or
xvi. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
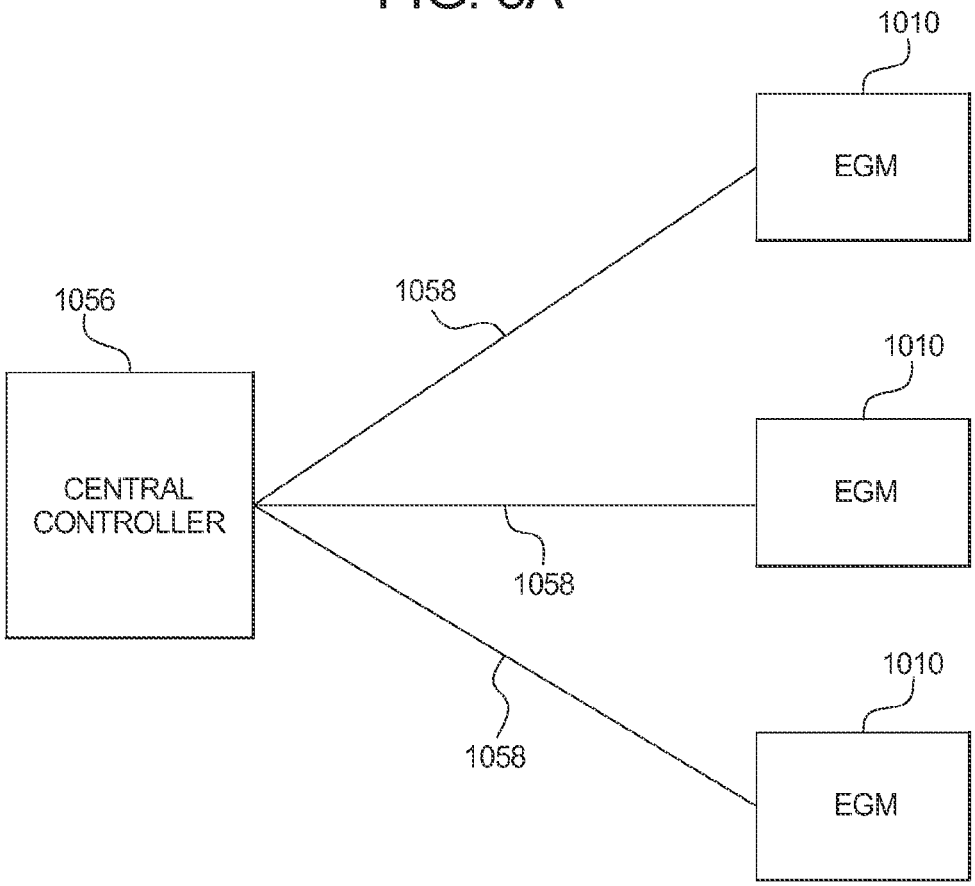
FIG. 3A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
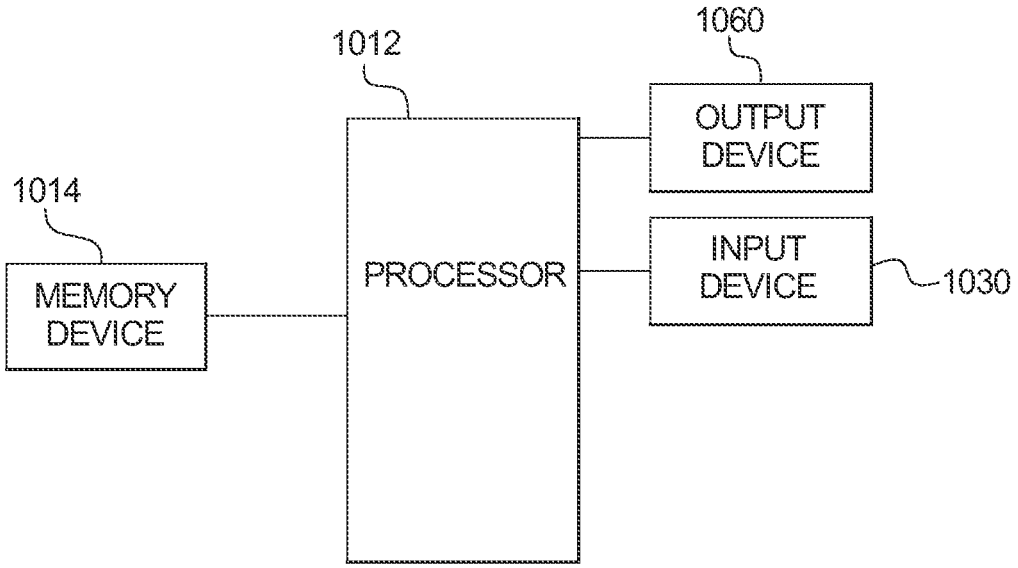
FIG. 3B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
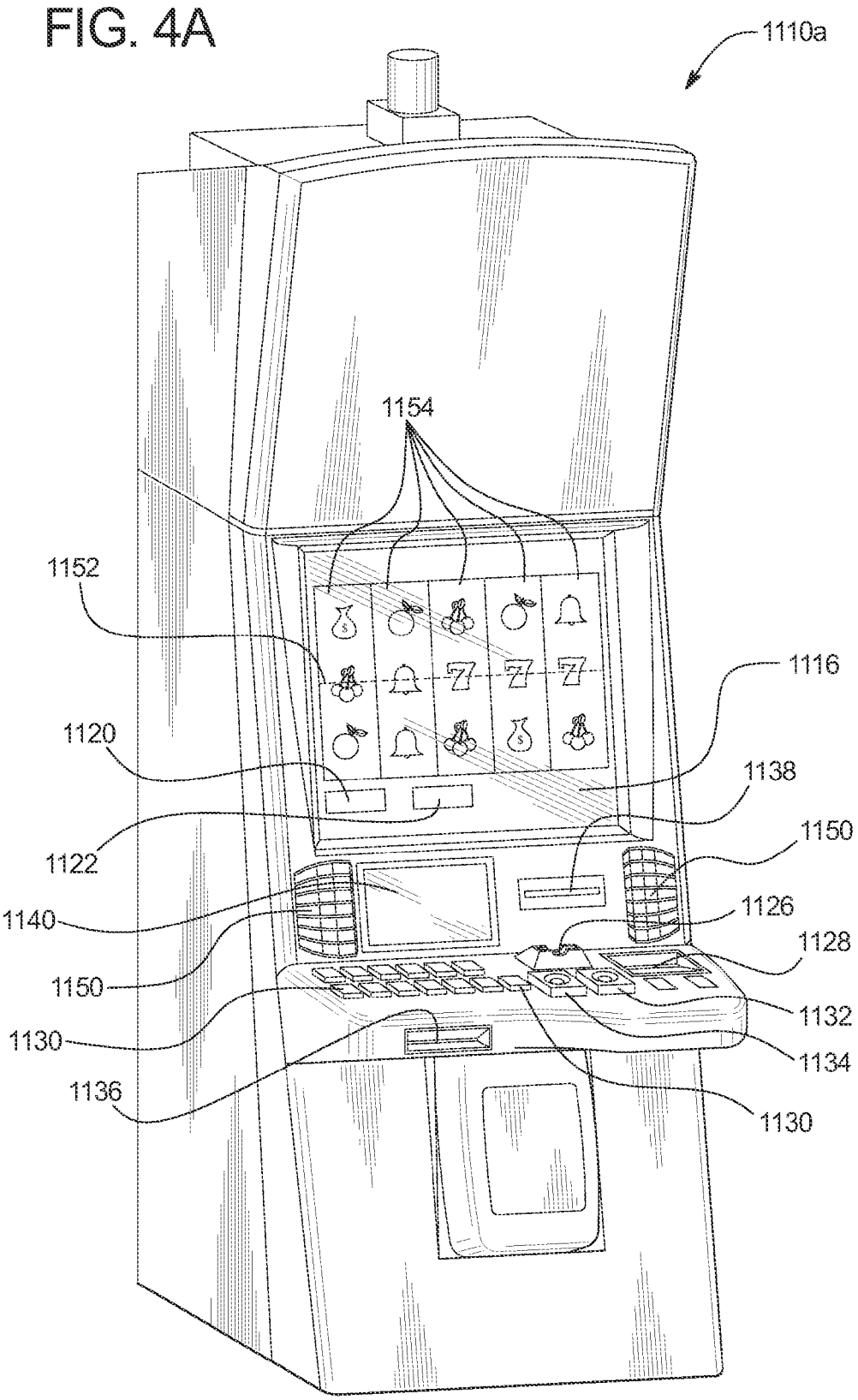
FIGS. 4A and 4B are perspective views of example alternative embodiments of the gaming system disclosed herein.
Figure 4B:
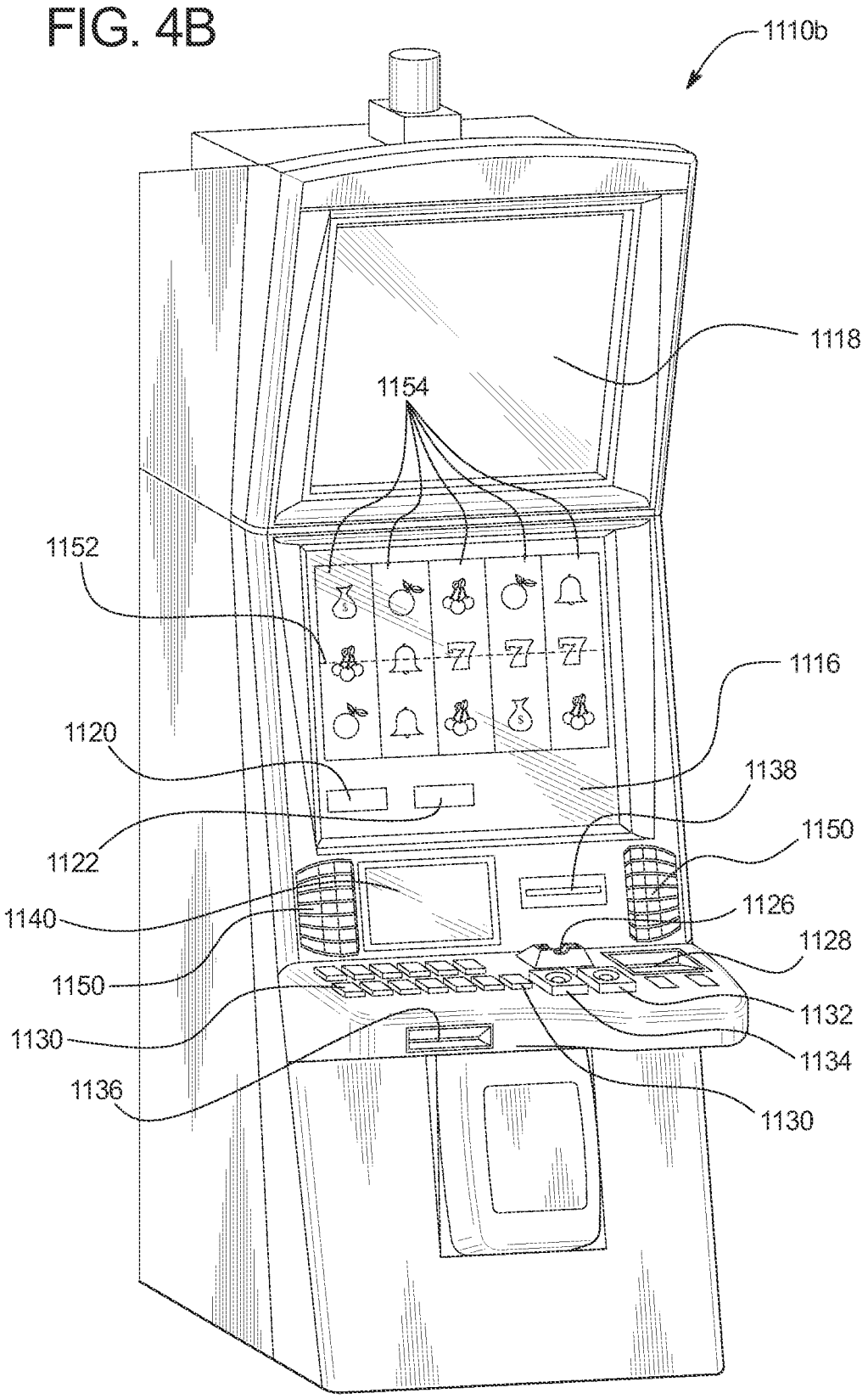

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels. SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281561 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 4A and 4B each include a payline 1152 and a plurality of reels 1156. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning patter, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311.605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

at least one display device supported by the housing;

a plurality of input devices supported by the housing, said plurality of input devices including:

(i) an acceptor, and (ii) a cashout device;

at least one processor; and at least one memory device which stores a plurality of instructions, which when executed by the at least one processor, cause the at least one processor to operate with the at least one display device and the plurality of input devices to:

(a) if a physical item is received via the acceptor, establish a credit balance based, at least in part, on a monetary value associated with the received physical item, (b) if a progressive award opportunity sequence triggering event occurs:

(i) display a progressive award, (ii) for each of at least one outcome determination:

(A) determine one of a plurality of different outcomes, wherein at least one of the plurality of different outcomes is associated with the progressive award, and (B) display the determined outcome, (iii) determine whether to provide the progressive award to a player, said determination being based on at least one of the displayed outcomes of the triggered progressive award opportunity sequence, and (iv) if the determination is not to provide the progressive award to the player:

(A) determine whether to trigger a progressive award supplemental opportunity sequence, said determination being based on at least one of the displayed outcomes of the triggered progressive award opportunity sequence, and (B) if the determination is to trigger the progressive award supplemental opportunity sequence:

(I) for each of at least one supplemental outcome determination:

°(1) determine one of a plurality of different supplemental outcomes, wherein at least one of the plurality of different supplemental outcomes is associated with the progressive award, and °(2) display the determined supplemental outcome, and (II) determine whether to provide the progressive award to the player, said determination being based on at least one of the displayed supplemental outcomes, and (c) if a cashout input is received via the cashout device, cause an initiation of any payout associated with the credit balance.

2. The gaming system of claim 1, wherein when executed by the at least one processor if the determination is to trigger the progressive award supplemental opportunity sequence, the plurality of instructions cause the at least one processor to:

(i) provide the progressive award to the player if the determination is provide the progressive award, and (ii) not provide the progressive award to the player if the determination is not to provide the progressive award.

3. The gaming system of claim 1, wherein the determination whether to provide the progressive award to the player is based on a first quantity of displayed outcomes associated with the progressive award.

4. The gaming system of claim 3, wherein the determination whether to trigger the progressive award supplemental opportunity sequence is based on a second, different quantity of displayed outcomes associated with the progressive award.

5. The gaming system of claim 4, wherein when executed by the at least one processor if the progressive award opportunity sequence triggering event occurs, the plurality of instructions cause the at least one processor to, for each of a plurality of outcome determinations, determine one of the plurality of different outcomes, wherein at least two of the outcome determinations are associated with different probabilities of determining the at least one outcome associated with the progressive award.

6. The gaming system of claim 1, wherein a determination that the progressive award opportunity sequence triggering event will occur is independent of any occurrence in any play of any displayed games.

7. The gaming system of claim 1, wherein when executed by the at least one processor, the plurality of instructions cause the at least one processor to display a plurality of progressive awards, each progressive award associated with a different progressive award opportunity sequence and a different progressive award supplemental opportunity sequence.

8. The gaming system of claim 1, wherein the progressive award includes at least one selected from the group consisting of: a quantity of monetary credits, a quantity of non-monetary credits, a quantity of promotional credits, a quantity of player tracking points, a quantity of free plays of a game, and a quantity of plays of at least one non-wagering game.

9. A gaming system server comprising:

at least one processor; and at least one memory device which stores a plurality of instructions, which when executed by the at least one processor if a progressive award opportunity sequence triggering event occurs, cause the at least one processor to:

(a) cause at least one display device to display a progressive award, (b) for each of at least one outcome determination:

(i) determine one of a plurality of different outcomes, wherein at least one of the plurality of different outcomes is associated with the progressive award, and (ii) cause the at least one display device to display the determined outcome, (c) determine whether to provide the progressive award to a player, said determination being based on at least one of the displayed outcomes of the triggered progressive award opportunity sequence, wherein a credit balance is increasable based on if the progressive award is provided to the player, said credit balance is increasable via an acceptor of a physical item associated with a monetary value, and an initiation of any payout associated with the credit balance is caused to occur if a cashout input is received via a cashout device, and (d) if the determination is not to provide the progressive award to the player:

(i) determine whether to trigger a progressive award supplemental opportunity sequence, said determination being based on at least one of the displayed outcomes of the triggered progressive award opportunity sequence, and (ii) if the determination is to trigger the progressive award supplemental opportunity sequence:

(A) for each of at least one supplemental outcome determination:

(I) determine one of a plurality of different supplemental outcomes, wherein at least one of the plurality of different supplemental outcomes is associated with the progressive award, and (II) cause the at least one display device to display the determined supplemental outcome, and (B) determine whether to provide the progressive award to the player, said determination being based on at least one of the displayed supplemental outcomes.

10. The gaming system server of claim 9, wherein when executed by the at least one processor if the determination is to trigger the progressive award supplemental opportunity sequence, the plurality of instructions cause the at least one processor to:

(i) cause the progressive award to be provided to the player if the determination is provide the progressive award, and (ii) cause the progressive award not to be provided to the player if the determination is not to provide the progressive award.

11. The gaming system server of claim 9, wherein the determination whether to provide the progressive award to the player is based on a first quantity of displayed outcomes associated with the progressive award.

12. The gaming system server of claim 11, wherein the determination whether to trigger the progressive award supplemental opportunity sequence is based on a second, different quantity of displayed outcomes associated with the progressive award.

13. The gaming system server of claim 12, wherein when executed by the at least one processor if the progressive award opportunity sequence triggering event occurs, the plurality of instructions cause the at least one processor to, for each of a plurality of outcome determinations, determine one of the plurality of different outcomes, wherein at least two of the outcome determinations are associated with different probabilities of determining the at least one outcome associated with the progressive award.

14. The gaming system server of claim 9, wherein a determination that the progressive award opportunity sequence triggering event will occur is independent of any occurrence in any play of any displayed games.

15. The gaming system server of claim 9, wherein when executed by the at least one processor, the plurality of instructions cause the at least one processor to cause the at least one display device to display a plurality of progressive awards, each progressive award associated with a different progressive award opportunity sequence and a different progressive award supplemental opportunity sequence.

16. The gaming system server of claim 9, wherein the progressive award includes at least one selected from the group consisting of: a quantity of monetary credits, a quantity of non-monetary credits, a quantity of promotional credits, a quantity of player tracking points, a quantity of free plays of a game, and a quantity of plays of at least one non-wagering game.

* * * * *